US012298087B2

(12) United States Patent
Lee et al.

(10) Patent No.: US 12,298,087 B2
(45) Date of Patent: May 13, 2025

(54) COVER FIN AND HEAT EXCHANGER UNIT INCLUDING THE SAME

(71) Applicant: KYUNGDONG NAVIEN CO., LTD., Pyeongtaek-si (KR)

(72) Inventors: Hong Ki Lee, Seoul (KR); In Chul Jeong, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 33 days.

(21) Appl. No.: 18/399,991

(22) Filed: Dec. 29, 2023

(65) Prior Publication Data

US 2024/0219128 A1 Jul. 4, 2024

(30) Foreign Application Priority Data

Dec. 29, 2022 (KR) ..... 10-2022-0189867
Dec. 29, 2022 (KR) ..... 10-2022-0189868

(51) Int. Cl.
*F28F 1/28* (2006.01)

(52) U.S. Cl.
CPC ..... *F28F 1/28* (2013.01)

(58) Field of Classification Search
CPC . F28F 1/28; F28F 1/00; F28F 2240/00; F28D 1/05366
USPC ..... 165/151
See application file for complete search history.

(56) References Cited

U.S. PATENT DOCUMENTS 7,302,997 B2 * 12/2007 Kozdras ..... F28F 9/002 165/166
9,909,821 B2 * 3/2018 Bardeleben ..... F28D 9/0056
12,178,013 B2 * 12/2024 DeMars ..... H05K 5/0204
2012/0255709 A1 * 10/2012 Kinder ..... F28F 9/0075 165/67
2012/0258337 A1 * 10/2012 Wang ..... H01M 10/625 429/50
2014/0318751 A1 10/2014 Kinder

FOREIGN PATENT DOCUMENTS

JP 2017133172 A 8/2017
JP 2019218858 A 12/2019

* cited by examiner

*Primary Examiner* — Jon T. Schermerhorn, Jr.
(74) *Attorney, Agent, or Firm* — Dinsmore & Shohl LLP; Yongsok Choi, Esq.

(57) ABSTRACT

Disclosed is a cover fin including a front part and a rear part being perpendicular to a forward/rearward direction and spaced apart from each other in the forward/rearward direction, a connecting part connecting the front part and the rear part, a leg part extending from an upper end of the rear part toward an upper side when one direction being perpendicular to the forward/rearward direction is defined as an upward/downward direction, and a protrusion protruding from the leg part to a rear side.

20 Claims, 23 Drawing Sheets

COVER FIN AND HEAT EXCHANGER UNIT INCLUDING THE SAME

CROSS-REFERENCE TO RELATED APPLICATIONS

This application claims the benefit of priority to Korean Patent Application Nos. 10-2022-0189867 and 10-2022-0189868, filed in the Korean Intellectual Property Office on Dec. 29, 2022, the entire contents of which are incorporated herein by reference.

TECHNICAL FIELD

The present disclosure relates to a cover fin, and a heat exchanger unit including the same.

BACKGROUND

In devices, such as boilers, water heaters, hot water mats, a burner including a heat source that emits heat, and a heat exchanger that heats heating water by transferring radiant heat emitted from the heat source and convective heat of a combustion gas generated by the burner to a heat medium are generally disposed.

A pipeline is placed in the heat exchanger, the heat medium flows along an interior of the pipeline, and the combustion gas flows outside the pipeline. Accordingly, the heat medium and the combustion gas indirectly exchange heat through the pipeline.

To facilitate heat exchange through the pipeline, a plurality of heat fins may be installed in the pipeline. This type of heat exchanger is referred to as a fin-tube type heat exchanger. Because the plate-shaped heat fins are inserted into the pipeline, a surface area that contacts the combustion gas increases, and a larger amount of heat may be transferred from the combustion gas to the heat medium.

A maintenance space for removing defective products or correct wrong brazing may be provided in an interior of the heat exchanger. For example, the maintenance space may be formed between front and rear plates of a heat exchanger case and the heat fins that are disposed at opposite ends of the pipeline.

However, the interior space provided for maintenance may have a negative influence on a performance of the heat exchanger. For example, superheated combustion gas that has not sufficiently exchanged heat in the interior of the heat exchanger may be discharged to an outside through the interior space, and the flow of superheated combustion gas may damage the heat fins disposed at opposite ends thereof and other components (e.g., a condensate receiver). For example, the heat fins may be deformed or the condensate receiver may be deformed or damaged by the heat of the combustion gas.

In addition, as the combustion gas bypasses through the interior space, sufficient heat is not supplied to the heat medium whereby an efficiency of heat exchange may decrease, and thus, a performance of the heat exchanger may decrease.

SUMMARY

The present disclosure has been made to solve the above-mentioned problems occurring in the prior art while advantages achieved by the prior art are maintained intact.

An aspect of the present disclosure provides a cover fin for preventing a combustion gas from bypassing, and a heat exchanger including the same.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, a cover fin includes a front part and a rear part being perpendicular to a forward/rearward direction and spaced apart from each other in the forward/rearward direction, a connecting part connecting the front part and the rear part, a leg part extending from an upper end of the rear part toward an upper side when one direction being perpendicular to the forward/rearward direction is defined as an upward/downward direction, and a protrusion protruding from the leg part to a rear side.

As an example, when a direction being perpendicular to the forward/rearward direction is defined as a leftward/rightward direction and the upward/downward direction, a width of the front part in the leftward/rightward direction may be smaller than a width of the rear part.

As an example, when a direction being perpendicular to the forward/rearward and the upward/downward direction is defined as a leftward/rightward direction, the connecting part may include a (1-1)-th connecting area connected to a lower end of the front part, and a (1-2)-th connecting area connecting the (1-1)-th connecting area and a lower end of the rear part, and a width of the (1-1)-th connecting area in the leftward/rightward direction may be smaller than a width of the (1-2)-th connecting area.

As an example, when a direction being perpendicular to the forward/rearward direction and the upward/downward direction is defined as a leftward/rightward direction, the front part may include a lower end area extending toward the upper side, and an upper end area, of which a width in the leftward/rightward direction decreases as it goes from the lower end area to the upper side.

As an example, when a direction being perpendicular to the forward/rearward direction and the upward/downward direction is defined as a leftward/rightward direction, the connecting part may have a shape that is curved to be convex downward when viewed along the leftward/rightward direction.

As an example, the protrusion may include a first protruding area curved from an upper end of the leg part toward a rear side, and a second protruding area curved from an upper end of the first protruding area toward a front side.

As an example, the leg part may include a first leg area extending from an upper end of the rear part to an upper side, and a second leg area extending from the first leg area and connected to the protrusion, and when a direction being perpendicular to the forward/rearward direction and the upward/downward direction is defined as a leftward/rightward direction, the first leg area may include an outer boundary inclined inward with respect to the upper side in the leftward/rightward direction, and an inner boundary inclined outward with respect to the upper side.

As an example, a direction, in which the inner boundary extends, and a direction, in which the outer boundary extends, may not be perpendicular to each other.

As an example, the cover fin may further include a cover part extending from an area being different from a partial area of the connecting part, which is connected to a lower end of the rear part, toward the rear side.

According to an aspect of the present disclosure, a cover fin includes a front part and a rear part being perpendicular to a forward/rearward direction and spaced apart from each other in the forward/rearward direction, a connecting part connecting the front part and the rear part, and a wing part protruding from a side surface of the connecting part in a leftward/rightward direction toward an upper side when one direction being perpendicular to the forward/rearward direction is defined as an upward/downward direction and another direction being perpendicular to the forward/rearward direction and the upward/downward direction is defined as the leftward/rightward direction.

As an example, the wing part may include a first wing area facing the upper side from the side surface and extending while being inclined to an outside of the connecting part, and a second wing area facing the upper side and extending from one end of the first wing area while being inclined inward, in the first wing area.

As an example, a plurality of grooves recessed toward a lower side may be formed at an upper end of the front part.

According to an aspect of the present disclosure, a cover fin includes a front part being perpendicular to a forward/rearward direction, a cover part extending from a lower end of the front part toward a rear side, and an insertion part protruding from a portion of the front part, which is located on an upper side of the cover part, toward the rear side, and a plurality of grooves recessed toward a lower side are formed at an upper end of the front part when one direction being perpendicular to the forward/rearward direction is defined as an upward/downward direction.

As an example, when a direction being perpendicular to the forward/rearward direction and the upward/downward direction is defined as a leftward/rightward direction, a width of the cover part in the leftward/rightward direction may be smaller than a width of the front part.

As an example, the cover fin may further include a flange part protruding from an upper end of a rear surface of the front part to the rear side while surrounding the plurality of grooves.

As an example, the flange part may include a plurality of grooves surrounding the plurality of groove flanges, and at least one connecting flange connecting the plurality of groove flanges.

As an example, the insertion part may include a lower boundary inclined upward with respect to the rear side in the upward/downward direction, and an upper boundary inclined downward with respect to the rear side.

According to another aspect of the present disclosure, a heat exchanger includes a plurality of heat exchange pipelines disposed in a heat exchange area configured to receive heat generated through a combustion reaction and heat heating water, and extending along a forward/rearward direction to receive the heating water and cause the heating water to flow through an interior thereof, a plurality of heat fins disposed in the heat exchange area, formed in a plate shape crossing the heat exchange pipelines, and through which the plurality of heat exchange pipelines pass, a front plate and a rear plate coupled to front ends and rear ends of the plurality of heat exchange pipelines, respectively, and a cover fin disposed in an interior space between, among the plurality of heat fins, a first heat fin disposed adjacent to the front ends of the plurality of heat exchange pipelines and the front plate, and inserted into the interior space from a lower side toward an upper side when one direction being perpendicular to the forward/rearward direction is defined as an upward/downward direction, and the cover fin includes a front part contacting the front plate, a rear part contacting the first heat fin, and a connecting part connecting the front part and the rear part.

As an example, the cover fin may include a leg part extending from an upper end of the rear part toward the upper side, and a protrusion protruding from the leg part to the rear side, and the protrusion may be inserted into a hole formed in the first heat fin.

As an example, the protrusion may be inserted into the hole formed in the first heat fin whereby the cover fin is disposed at a lower end of the interior space, which is adjacent to an outside of the heat exchanger.

As an example, the cover fin may further include a cover part extending from an area being different from a partial area of the connecting part connected to a lower end of the rear part toward the rear side, and the cover part may cover lower ends of the plurality of heat fins.

As an example, the cover fin may further include, when a direction being perpendicular to the forward/rearward direction and the upward/downward direction is defined as a leftward/rightward direction, a side plate connecting the front plate and the rear plate, the cover fin may further include a wing part protruding from a side surface of the connecting part in the leftward/rightward direction toward an upper side, and the wing part may contact the side plate whereby the cover fin is fixed to the side plate.

As an example, a plurality of (1-1)-th grooves recessed toward a lower side and a plurality of (1-2)-th grooves recessed toward the lower side between the (1-1)-th grooves to be thinner than the plurality of (1-1)-th grooves may be formed at an upper end of the front part of the cover fin, and the plurality of (1-2)-th grooves may contact the plurality of heat exchange pipelines.

As an example, the plurality of (1-2)-th grooves may contact the plurality of heat exchange pipelines whereby the cover fin is disposed at a lower end of the interior space, which is adjacent to an outside of the heat exchanger.

As an example, the cover fin may be attached to and detached from the heat exchanger in the upward/downward direction.

As an example, the cover fin may be disposed also in an interior space between, among the plurality of heat fins, a second heat fin disposed adjacent to rear ends of the plurality of heat exchange pipelines and the rear plate.

According to an aspect of the present disclosure, a heat exchanger includes a plurality of heat exchange pipelines disposed in a heat exchange area configured to receive heat generated through a combustion reaction and heat heating water, and extending along a forward/rearward direction to receive the heating water and cause the heating water to flow through an interior thereof, a plurality of heat fins disposed in the heat exchange area, formed in a plate shape crossing the plurality of heat exchange pipelines, and through which the plurality of heat exchange pipeline pass, a front plate and a rear plate coupled to front ends and rear ends of the plurality of heat exchange pipelines, respective, and a cover fin disposed in an interior space between, among the plurality of heat fins, a first heat fin disposed adjacent to front ends of the heat exchange pipelines and the front plate, and inserted into the interior space from a lower side toward an upper side when one direction being perpendicular to the forward/rearward direction is defined as an upward/downward direction, the cover fin includes a front part contacting the front plate, a cover part extending from a lower end of the front part toward a rear side, and an insertion part protruding from a portion of the front part, which is located on an upper side of the cover part toward the rear side, a plurality of grooves recessed toward a lower side are formed at an upper end of the front part, and the insertion part contacts the first heat fin and the front plate whereby the cover fin is fixed to the first heat fin.

As an example, a width of the cover part in a leftward/rightward direction may be greater than a width of the front part when a direction being perpendicular to the forward/rearward direction and the upward/downward direction is defined as the leftward/rightward direction.

As an example, the cover fin may further include a flange part protruding from an upper end of a rear surface of the front part while surrounding the plurality of grooves.

As an example, the flange part may include a plurality of groove flanges surrounding the plurality of grooves, and at least one connecting flange connecting the plurality of groove flanges.

As an example, a plurality of heat exchange pipelines may be seated on the plurality of groove flanges and the at least one connecting flange, and the plurality of heat exchange pipelines may be seated whereby the cover fin is disposed at a lower end of the interior space, which is adjacent to an outside of the heat exchanger.

As an example, the insertion part may include a lower boundary inclined upward while extending from a portion of the front part, which is adjacent to the cover part, to a rear side, in the upward/downward direction, and an upper boundary inclined downward while extending rearward from another portion of the front part, which is spaced apart from the cover part.

As an example, a distance from a portion of the front part, from which the insertion part extends, to one point, at which the lower boundary and the upper boundary meet each other, may be greater than or substantially the same as a distance between the front plate and the first heat fin.

As an example, the cover part may cover lower ends of the plurality of heat fins.

As an example, the plurality of heat exchange pipelines may be inserted into the plurality of grooves, and the plurality of heat exchange pipelines may be inserted into the plurality of grooves whereby the cover fin is disposed at a lower end of the interior space, which is adjacent to an outside of the heat exchanger.

As an example, the cover fin may be attached to and detached from the heat exchanger toward upper and lower sides.

As an example, the cover fin may be disposed even in an interior space between, among the plurality of heat fins, a second heat fin disposed adjacent to rear ends of the plurality of heat exchange pipelines and the rear plate.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
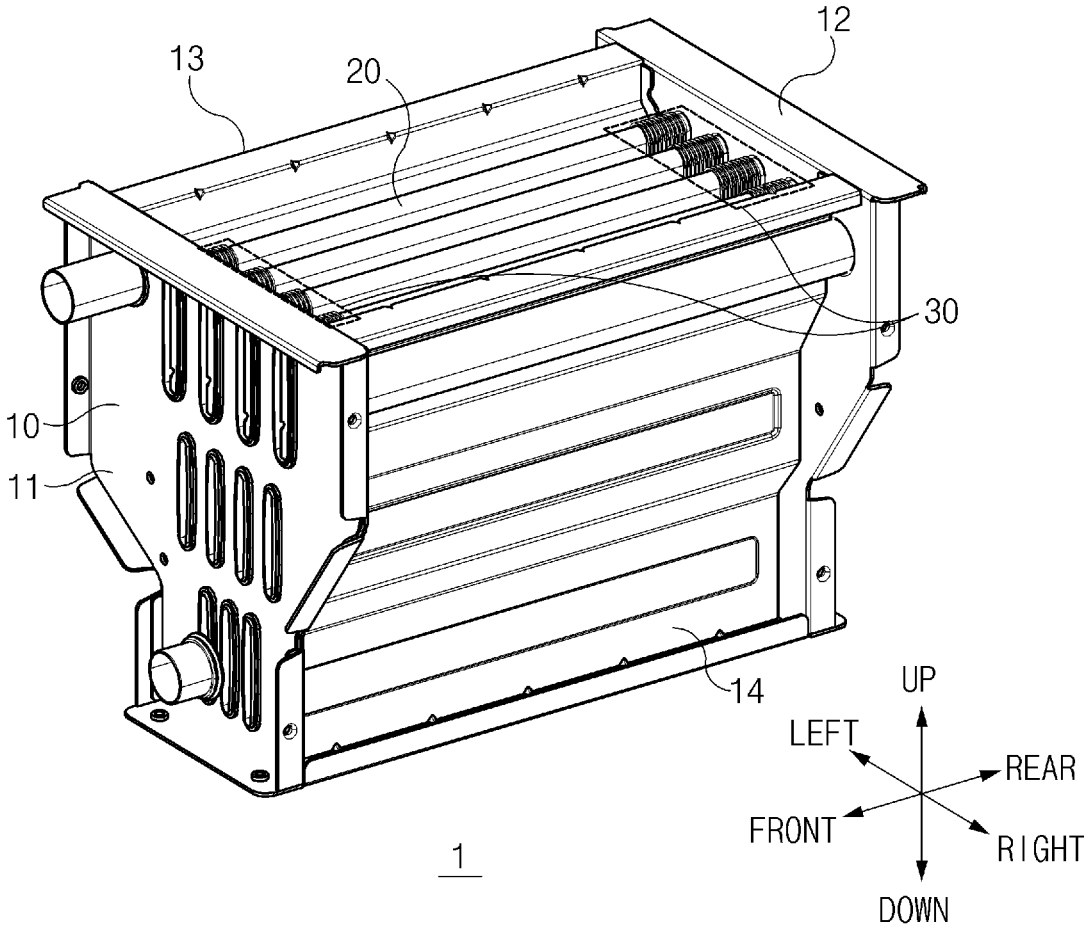
FIG. 1 is a perspective view of a heat exchanger.

Hereinafter, embodiments of the present disclosure will be described in detail with reference to the accompanying drawings. In adding reference numerals to the components of the drawings, it is noted that the same components are denoted by the same reference numerals even when they are drawn in different drawings. Furthermore, in describing the embodiments of the present disclosure, when it is determined that a detailed description of related known configurations and functions may hinder understanding of the embodiments of the present disclosure, a detailed description thereof will be omitted.

Furthermore, in describing the components of the embodiments of the present disclosure, terms, such as first, second, "A", "B", (a), and (b) may be used. The terms are simply for distinguishing the components, and the essence, the sequence, and the order of the corresponding components are not limited by the terms. When it is described that a certain component is "connected to", "coupled to" or "electrically connected to" a second component, it should be understood that the component may be directly connected or electrically connected to the second component, but a third component may be "connected" or "electrically connected" between the components.

In the specification, a leftward/rightward direction and an upward/downward direction are referred for convenience of description, and may be directions that are perpendicular to each other. However, the directions are determined relatively to a direction, in which a heat exchanger is arranged, and the upward/downward direction may not always mean a vertical direction.

Furthermore, the word pipeline used below may refer to a tube-shaped pipe, through which a fluid may flow, and refers to a component that may have various materials and shapes, such as a soft tube and a metal pipe.

A heat exchanger 1 disposed in an interior of a boiler may heat heating water by transferring convection heat of a combustion gas to a heat medium.

Hereinafter, a lengthwise direction of the heat exchanger 1 will be referred to as a forward/rearward direction, a height direction of the heat exchanger will be referred to as an upward/downward direction, and a direction that is perpendicular to the forward/rearward direction and the upward/downward direction will be referred to as a leftward/rightward direction.

FIG. 1 is a perspective view of a heat exchanger.

Figure 2:
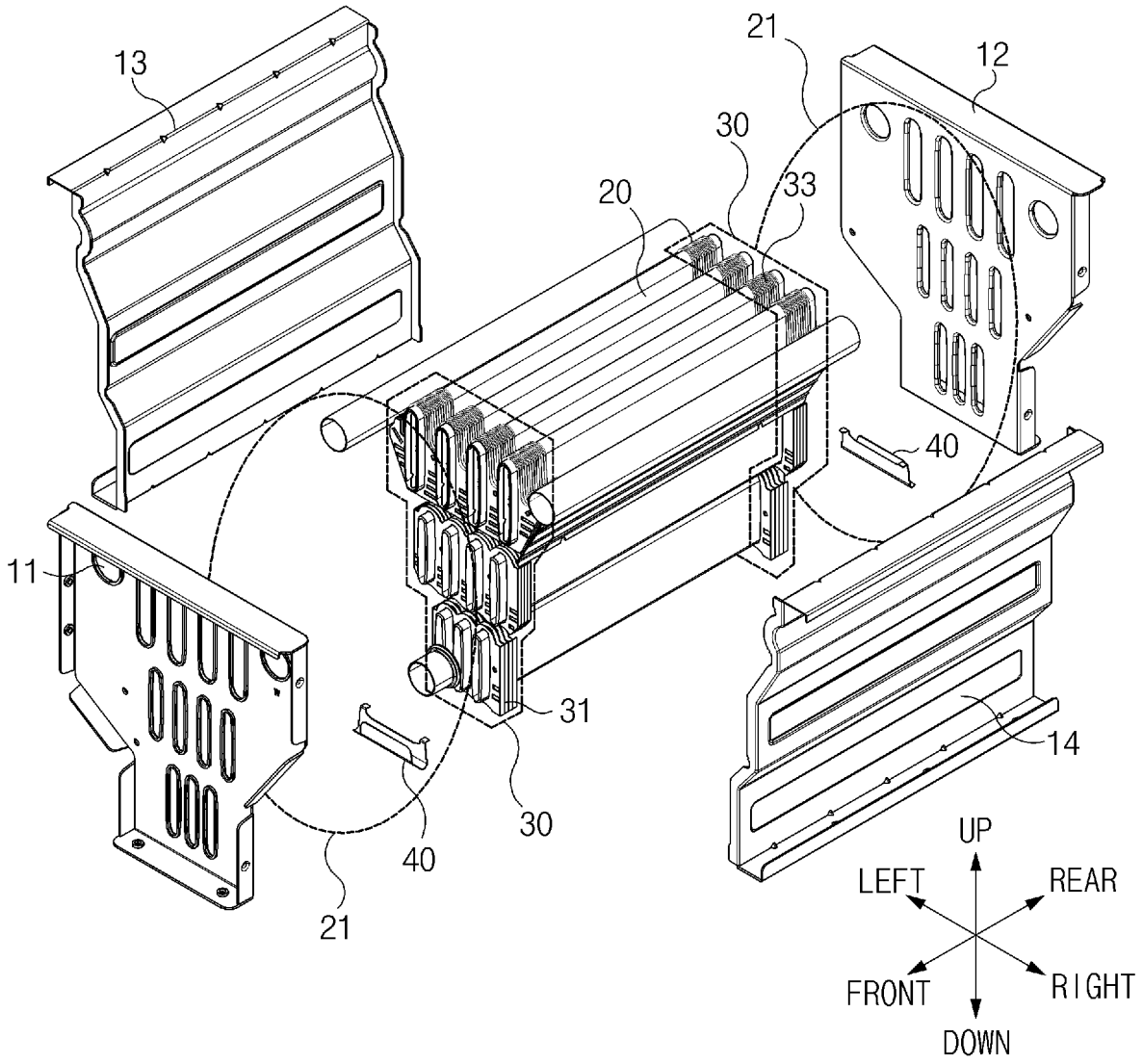
FIG. 2 is an exploded view of a heat exchanger.

FIG. 2 is an exploded view of the heat exchanger.

Figure 3:
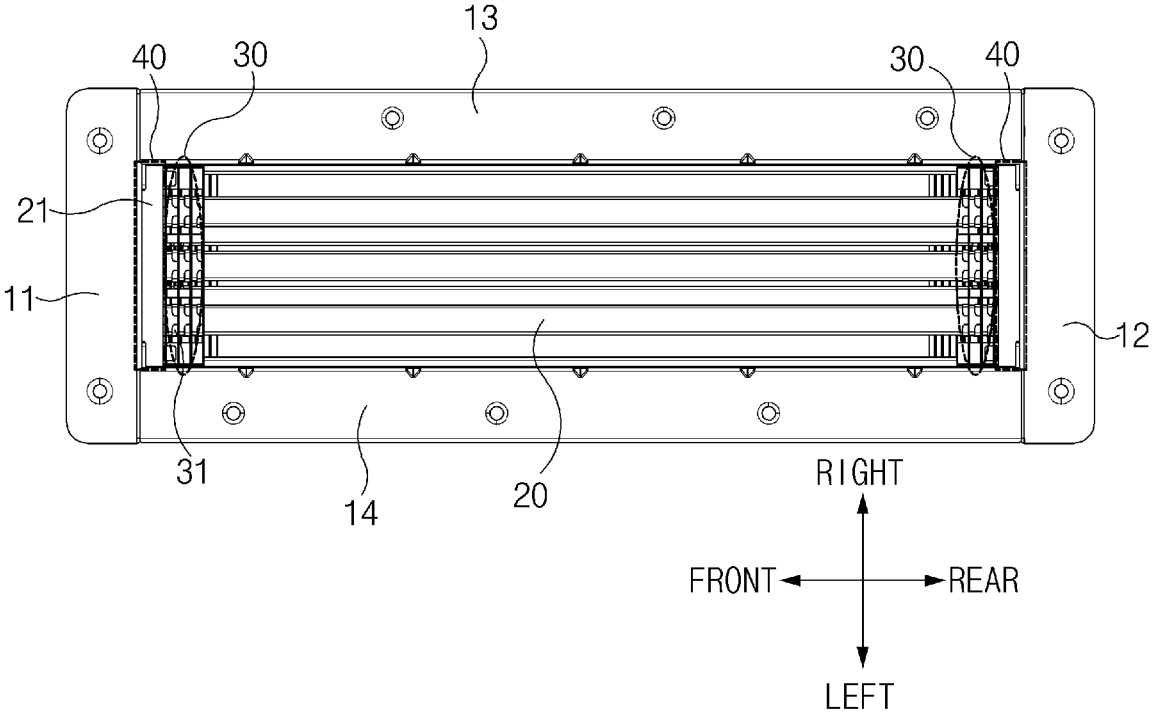
FIG. 3 is a bottom view illustrating a lower part of a heat exchanger.

FIG. 3 is a cross-sectional view illustrating a lower part of the heat exchanger.

Referring to FIGS. 1 to 3, the heat exchanger 1 may include a heat exchanger case 10, a plurality of heat exchange pipelines 20, a plurality of heat fins 30, and a cover fin 40.

In detail, the heat exchanger 1 may include the plurality of heat exchange pipelines 20, through which the heating water flows in interiors thereof, and the combustion gas flows therearound, and may include the heat exchanger case 10, into which opposite ends of the plurality of heat exchange pipelines 20 are inserted. The plurality of heat exchange pipelines 20 may be located inside the heat exchanger case 10, and the heat exchanger 1 may be configured such that the combustion gas in an interior of the heat exchanger 1 flows around the plurality of heat exchange pipelines 20 to indirectly exchange heat with the heating water flowing in the interiors of the plurality of heat exchange pipelines 20.

Heat Exchanger Case 10 the heat exchanger case 10 may include a front plate 11, a rear plate 12, and side plates 13 and 14.

The front plate 11 may face a front side, and may cover a front surface of the heat exchanger 1. The rear plate 12 may face a rear side, and may cover a rear surface of the heat exchanger 1. The side plates 13 and 14 may face side surfaces of the heat exchanger 1, and may cover the side surfaces of the heat exchanger 1. The side plates 13 and 14 may connect the front plate 11 and rear plate 12. The side plates 13 and 14 may include the left plate 13 and the right plate 14.

Plurality of Heat Exchange Pipelines 20

A plurality of heat exchange pipelines 20 may be disposed in an interior of the heat exchanger 1. For example, the plurality of heat exchange pipelines 20 may be disposed in a heat exchange area that receives heat generated through a combustion reaction in the interior of the heat exchanger 1 to heat heating water.

The plurality of heat exchange pipelines 20 may be constituted as a plurality of layers. For example, among the plurality of heat exchange pipelines 20 formed as the plurality of layers, a heat exchange pipeline on an upper layer may transfer sensible heat to the heating water. Among the plurality of heat exchange pipelines 20 formed as the plurality of layers, a heat exchange pipeline on a lower layer may heat the heating water by transferring latent heat when the combustion gas is condensed.

The plurality of heat exchange pipelines 20 may extend along the forward/rearward direction. For example, the plurality of heat exchange pipelines 20 may extend along the forward/rearward direction to connect the front plate 11 and the rear plate 12. For example, the front plate 11 and the rear plate 12 may be coupled to front and rear ends of the plurality of heat exchange pipelines 20, respectively. For example, the plurality of heat exchange pipelines 20 may be inserted into some of holes that are formed in the front plate 11 and the rear plate 12 to connect the front plate 11 and the rear plate 12.

The heating water may flow through the plurality of heat exchange pipelines 20. For example, the plurality of heat exchange pipelines 20 may receive the heating water and cause it to flow in the pipelines.

Plurality of Heat Fins 30

The plurality of heat fins 30 may be disposed in the interior of the heat exchanger 1. For example, the plurality of heat fins 30 may be disposed in the heat exchange area that receives the heat generated by the combustion reaction in the interior of the heat exchanger 1 to heat the heating water.

The plurality of heat fins 30 may be formed in a plate shape that crosses the plurality of heat exchange pipelines 20. For example, the plurality of heat fins 30 may include a plurality of holes, and the plurality of heat exchange pipelines 20 may pass through the plurality of holes.

The plurality of heat fins 30 may be disposed overall in the plurality of heat exchange pipelines 20. Referring to FIGS. 1 to 3, it is illustrated that the plurality of heat fins 30 are disposed at the ends of the plurality of heat exchange pipelines 20, which are adjacent to the front plate 11 and the rear plate 12, but this is only an example for convenience of description, and the locations of the plurality of heat fins 30 are not limited to the locations illustrated.

For example, the plurality of heat fins 30 extend overall from ends of the plurality of heat exchange pipelines 20, which are adjacent to the front plate 11, to opposite ends of the plurality of heat exchange pipelines 20, which are adjacent to the rear plate 12.

As the plurality of heat fins 30 are disposed, surface areas that contact the combustion gas increase, and a larger amount of heat may be transferred from the combustion gas to the heat medium.

Cover Fin 40

The cover fin 40 may be disposed between the heat exchanger case 10 and the plurality of heat fins 30 in the interior of the heat exchanger 1. For example, the cover fin 40 may be disposed in an interior space 21 between, among the plurality of heat fins 30, a first heat fin 31 that is disposed at ends of the heat exchange pipelines 20, and the front plate 11. It has been described as an example that the cover fin 40 is disposed in the interior space 21 between the first heat fin 31 and the front plate 11, but the present disclosure is not limited thereto. For example, the cover fin 40 may be disposed in the interior space between, among the plurality of heat fins 30, a second heat fin 33 that is disposed at opposite ends of the plurality of heat exchange pipelines 20, and the rear plate 12.

Hereinafter, it will be described as an example that the interior space, in which the cover fin 40 described later is disposed, is an interior space 21 that is formed between the front plate 11 and the first heat fin 31, but the location of the interior space 21 is not limited thereto.

The cover fin 40 may be inserted from a lower side of the heat exchanger 1 toward an upper side. For example, the cover fin 40 may be inserted from the lower side toward the upper side to be disposed in the interior space 21 between the front plate 11 and the first heat fin 31.

The interior space 21, in which the cover fin 40 is disposed, may be a partial area of a lower end of the interior space 21 formed between the front plate 11 and the first heat fin 31, but the location is limited thereto.

Cover fins 100, 200, 300, 400, 500, 600, and 700 that are described later as the cover fin 40 may be used.

Figure 4:
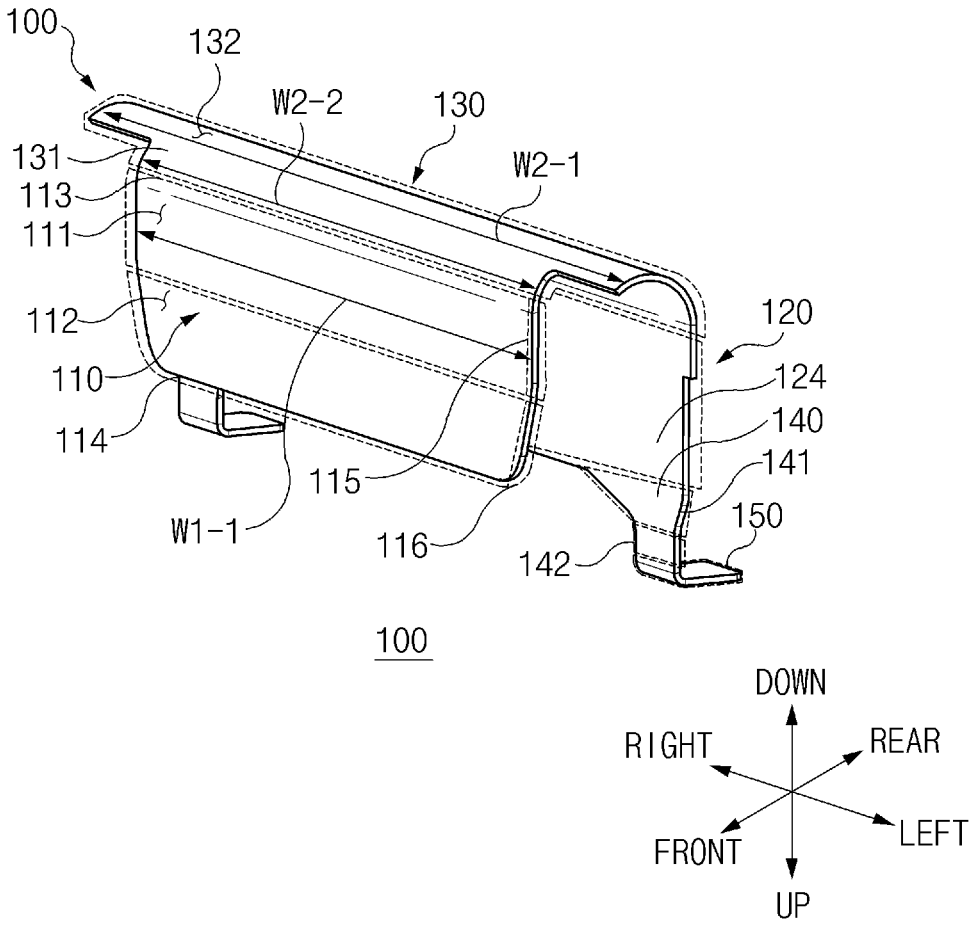
FIG. 4 is a perspective view of a cover fin according to a first embodiment.

FIG. 4 is a perspective view of a cover fin according to a first embodiment.

Figure 5:
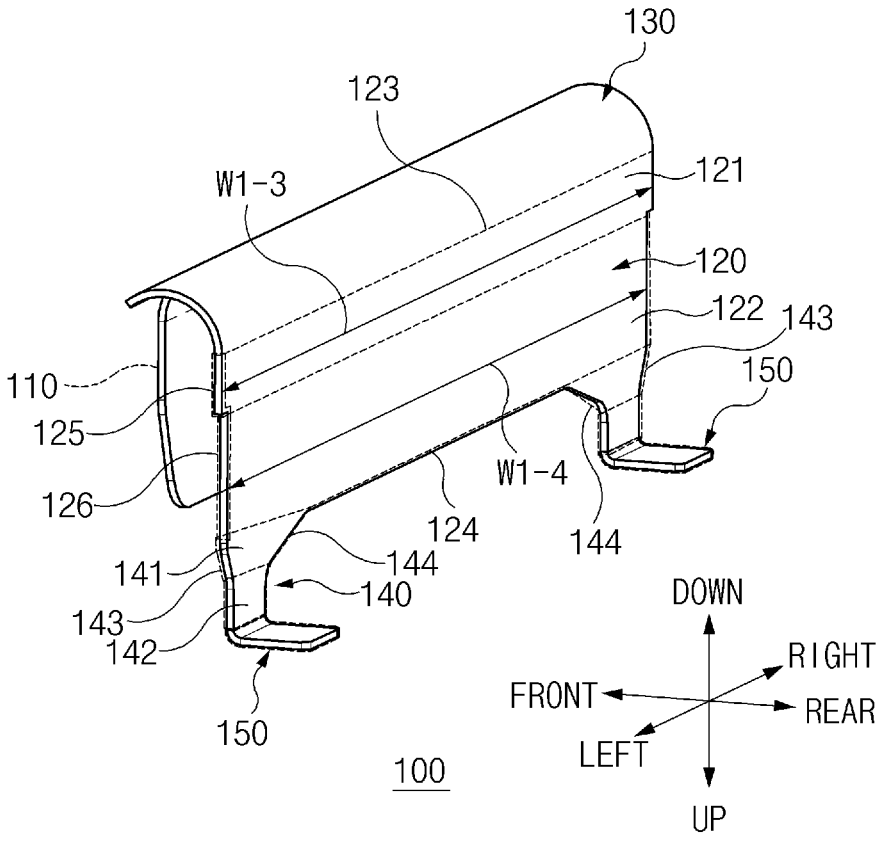
FIG. 5 is a perspective view of the cover fin of FIG. 4, viewed from another direction.

FIG. 5 is a perspective view of the cover fin of FIG. 4, viewed from another direction.

Figure 6:
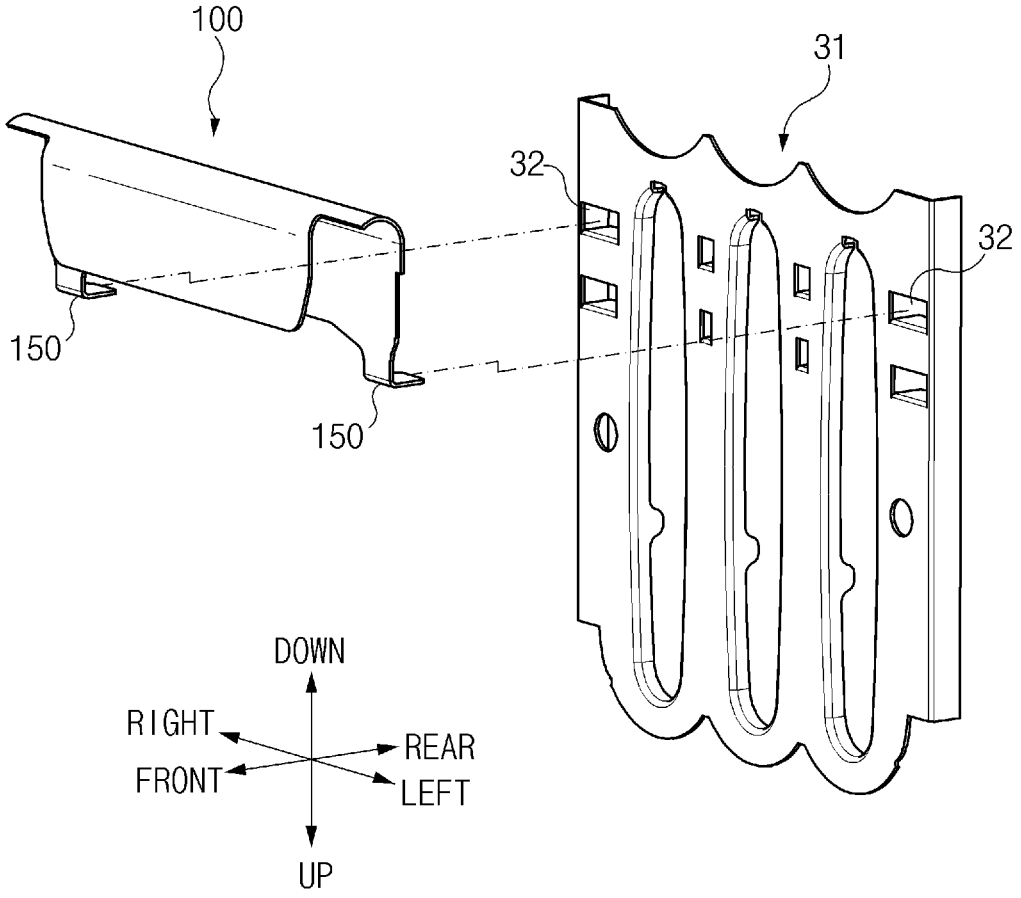
FIG. 6 is a view illustrating a cover fin and a first heat fin.

FIG. 6 is a view illustrating a cover fin and a first heat fin.

Figure 7:
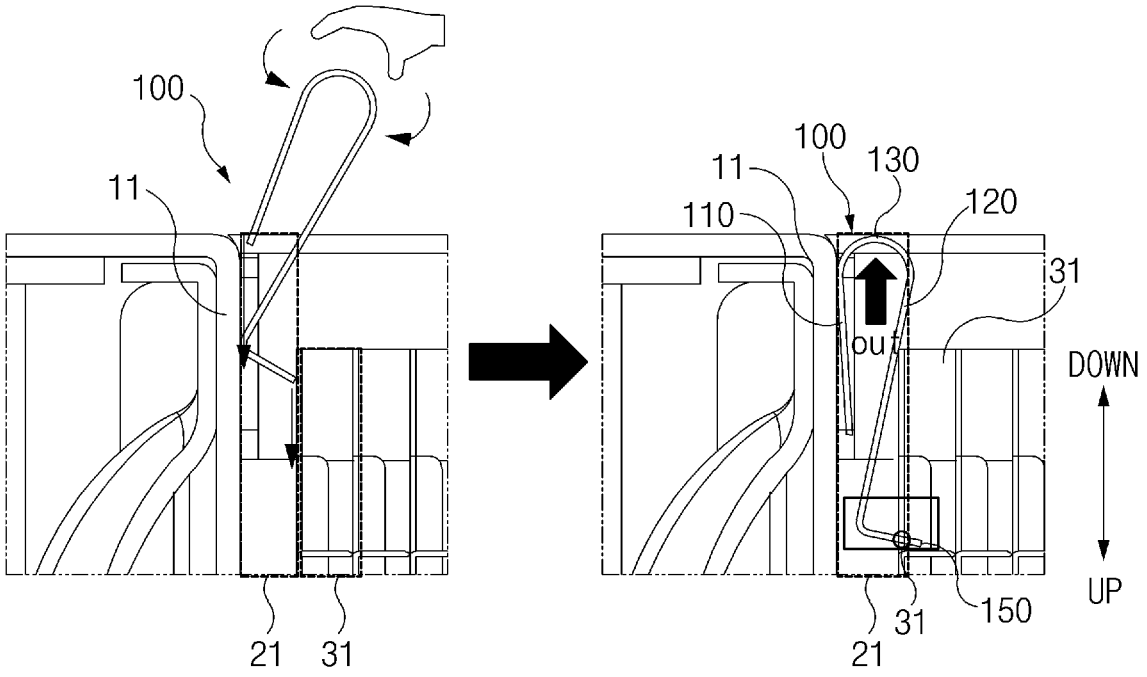
FIG. 7 is a view illustrating a state, in which a cover fin is disposed in an interior of a heat exchanger.

FIG. 7 is a view illustrating a state, in which the cover fin is disposed in the interior of the heat exchanger.

A cover fin 100 may be disposed in the interior space 21 between the front plate 11 and the first heat fin 31. As the cover fin 100 is disposed in the interior space 21, the combustion gas may be prevented from bypassing through the interior space 21 between the front plate 11 and the first heat fin 31.

Referring to FIGS. 4 and 5, the cover fin 100 may include a front part 110, a rear part 120, and a connecting part 130.

Front Part 110

The front part 110 may include a surface that faces a front side and contacts the front plate 11. The front part 110 may be formed as a plate, an outer surface of which faces the front side and an inner surface of which faces the rear side or the rear part. For example, the front part 110 may be formed as a flat plate. For example, when the cover fin 100 is disposed in the interior space between the front plate 11 and the first heat fin 31, the front part 110 may contact the front plate 11. For example, the outer surface of the front part 110 may contact the front plate 11.

At least a portion of a side surface of the front part 110 may be formed to be inclined. For example, the side surface of the front part 110 may include a (1-1)-th front part side area 115 and a (1-2)-th front part side area 116.

The (1-1)-th front part side area 115 may extend upward from the lower end thereof connected to the connecting part 130, which will be described later. The (1-2)-th front part side area 116 may extend upward from the (1-1)-th front part side area 115. For example, the (1-2)-th front part side area 116 may be formed to be inclined from the (1-1)-th front part side area 115 inward with respect to the upper side.

A lower end area 111 of the front part 110 may extend upward, and an upper end area 112 of the front part 110 may decrease in width in the leftward/rightward direction as it goes upward. For example, the lower end area 111 of the front part 110 including the (1-1)-th front part side area 115 may have a (1-1)-th width W1-1. The upper end area 112 of the front part 110 including the (1-2)-th front part side area 116 may gradually decrease in length as it extends upward. The (1-2)-th front part side area 116 may be connected to an upper end 114 of the front part 110.

Rear Part 120

The rear part 120 may include one surface that faces a rear side and contacts the first heat fin 31. The rear part 120 may be formed as a plate an outer surface of which faces the rear side and an inner surface of which faces the front side or the front part. For example, the rear part 120 may be formed as a flat plate. For example, when the cover fin 100 is disposed in the interior space 21 between the front plate 11 and the first heat fin 31, the rear part 120 may contact the first heat fin 31. For example, an outer surface of the rear part 120 may contact the first heat fin 31.

The rear part 120 and the front part 110 may be disposed to be perpendicular to the forward/rearward direction and to be spaced apart from each other in the forward/rearward direction.

A side surface of the rear part 120 may form a step. For example, referring to FIG. 5, the side surface of the rear part 120 may include a (2-1)-th rear part side area 125 and a (2-2)-th rear part side area 126. A step may be formed between the (2-1)-th rear part side area 125 and the (2-2)-th rear part side area 126. For example, a lower end area 121 of the rear part 120, in which the (2-1)-th rear part side area 125 is formed, may have a (1-3)-th width W1-3, and an upper end area 122 of the rear part 120, in which the (2-2)-th rear part side area 126 is formed, may have a (1-4)-th width W1-4, Because the (1-3)-th width W1-3 is formed longer than the (1-4)-th width W1-4, a step may be formed between the (2-1)-th rear part side area 125 and the (2-2)-th rear part side area 126.

The width of the front part 110 may be smaller than the width of the rear part 120. For example, the (1-1)-th width W1-1 of the upper end area 112 of the front part 110 in the leftward/rightward direction may be smaller than the (1-3)-th width W1-3 and the (1-4)-th width W1-4 of the rear part 120. For example, because the width of the front part 110 is formed to be smaller than that of the rear part 120, a portion of the rear part 120 may overlap the front part 110 when viewed from the front side toward the rear side. When viewed from the rear side toward the front side, because the width of the front part 110 is smaller than that of the rear part 120, the entire front part 110 may overlap the rear part 120.

Because the width of the front part 110 is smaller than the width of the rear part 120, the cover fin 100 may be disposed in the interior space even in the front plate 11, in which a step is formed on an inner side thereof through brazing.

Because the width of the front part 110 is formed to be smaller than the width of the rear part 120, material costs of the cover fin 100 may be reduced.

Connecting Part 130

The cover fin 100 may have a shape that is similar to that formed by bending a plate. For example, the connecting part 130 of the cover fin 100 may be formed in a shape that is curved from the lower side upward. For example, the connecting part 130 may have a shape that is curved to be convex downward when viewed along the leftward/rightward direction.

The connecting part 130 may be curved at a lower end 113 of the front part 110 and a lower end 123 of the rear part 120, and may connect the front part 110 and the rear part 120. For example, the connecting part 130 may include a (1-1)-th connecting area 131 that is connected to the lower end 113 of the front part 110 and a (1-2)-th connecting area 132 connecting the (1-1)-th connecting area 131 and the lower end 123 of the rear part 120.

A (2-1)-th width W2-1 of the (1-1)-th connecting area 131 in the leftward/rightward direction may be smaller than a (2-2)-th width W2-2 of the (1-2)-th connecting area 132 in the leftward/rightward direction. Because the width of the (1-1)-th connecting area 131 is formed to be smaller than the width of the (1-2)-th connecting area 132, a step may be formed on a side surface of the (1-1)-th connecting area 131 and a side surface of the (1-2)-th connecting area 132.

Because the step is formed between the side surface of the (1-1)-th connecting area 131 and the side surface of the (1-2)-th connecting area 132, a user may easily remove the cover fin 100 inserted into the interior space between the front plate 11 and the first heat fin 31 from the interior space. For example, because the step is formed, the user may easily extract the cover fin 100 from the interior space 21 by pinching an area, in which the step is formed, by using a tool, such as tweezers or pliers.

Leg Part 140

The cover fin 100 may further include a leg part 140. The leg part 140 may extend upward from an upper end 124 of the rear part 120. For example, the leg part 140 may extend upward from opposite ends of the upper end 124 of the rear part 120.

The leg part 140 may include a first leg area 141 and a second leg area 142. The first leg area 141 may be an area that extends upward from the upper end of the rear part 120, and the second leg area 142 may be another area that extends upward from the first leg area 141 and is connected to a protrusion 150 that will be described later.

The first leg area 141 may include an outer boundary 143 that is inclined inward with respect to the upper side in the leftward/rightward direction, and an inner boundary 144 that is inclined outward with respect to the upper side.

The outer boundary 143 may extend from a partial area of the upper end of the rear part 120, which is adjacent to the (2-2)-th rear part side area 126 of the rear part 120 while being inclined inward with respect to the upper side. The inner boundary 144 may extend another area of the upper end 124 of the rear part 120, which is spaced apart from the (2-2)-th rear part side area 126 of the rear part 120 while being inclined outward with respect to the upper side. That is, due to the outer boundary 143 and the inner boundary 144, the width of the first leg area 141 in the leftward/rightward direction may gradually decrease as the first leg area 141 extends upward.

A direction, in which the outer boundary 143 of the first leg area 141 and the inner boundary 144 of the first leg area 141 extend, may not be perpendicular to each other. For example, the width of the first leg area 141 may gradually decrease with respect to the leftward/rightward direction as it goes upward.

Because the width of the first leg area 141 gradually decreases as it goes upward, the cover fin 100 may secure a stronger strength than the cover fin 100 including a leg part with a constant width. For example, as the width of the first leg area 141 gradually decreases upward, the strength of the leg part 140 may increase. Because the strength of the leg part 140 increases, a durability of the cover fin 100 may increase.

Protrusion 150

The cover fin 100 may further include the protrusion 150.

The protrusion 150 may protrude rearward from the leg part 140. For example, the protrusion 150 may be curved toward the rear side at the upper end of the leg part 140. As another example, the protrusion 150 may protrude toward the rear side from a partial area other than the upper end of the leg part 140.

The protrusion 150 may be inserted into a hole 32 of the first heat fin 31. For example, because the protrusion 150 is inserted into the hole 32 of the first heat fin 31, the cover fin 100 may be fixed to the first heat fin 31.

As the protrusion 150 is inserted into the hole 32 of the first heat fin 31, a depth, by which the cover fin 100 is inserted, may be limited. For example, referring to FIG. 6, the hole 32 of the first heat fin 31 may be formed in an area that is adjacent to the lower end of the first heat fin 31. Because the protrusion 150 is inserted into the hole 32 formed in the area adjacent to the lower end of the first heat fin 31, the cover fin 100 may be disposed in the area that is adjacent to the lower end of the first heat fin 31.

Because the cover fin 100 is disposed in the area that is adjacent to the lower end of the first heat fin 31, the cover fin 100 may not be disposed deep in the interior space 21. As the protrusion 150 is inserted into the hole 32, the cover fin 100 may be prevented from being disposed deep in the interior space 21. Because the cover fin 100 is prevented from being disposed deep in the interior space 21, the user may easily remove the cover fin 100 from the interior space. Because the cover fin 100 is easily removed, maintenance of the heat exchanger 1 through the interior space 21 may be facilitated.

The cover fin 100 may have a thickness ranging from about 0.3 mm to about 0.4 mm, but the thickness is not limited thereto. Because the cover fin 100 is formed to be within about 0.3 mm to about 0.4 mm, the user may easily bend the cover fin 100.

The cover fin 100 may be formed in a shape that has a restoring force. For example, the cover fin 100 may be formed in a shape, in which the connecting part 130 has a restoring force while being curved.

Referring to FIG. 7, the cover fin 100 may be deflected inward due to a force applied by the user. For example, the cover fin 100 may be curved by the user as illustrated in FIG. 7. For example, because the connecting part 130 of the cover fin 100 is curved, the front part 110 and the rear part 120 may be moved in directions that face each other.

As the cover fin 100 is curved, the cover fin 100 may be inserted into the interior space 21.

When the force by the user is removed while the cover fin 100 is inserted into the interior space 21, the cover fin 100 may return to its original shape by the restoring force of the cover fin 100. In a process of the cover fin 100 returning to its original shape, the front part 110 may be supported by the front plate 11 and the rear part 120 may be supported by the first heat fin 31. Because the cover fin 100 is supported by the front plate 11 and the first heat fin 31 by restoring force, the cover fin 100 may be fixed to the interior space 21.

The protrusion 150 is inserted into the hole 32 of the first heat fin 31, and the cover fin 100 is supported on the front plate 11 and the first heat fin 31 by the restoring force, whereby the cover fin 100 may be fixed to the interior space 21.

Because the cover fin 100 is fixed to the interior space 21, the cover fin 100 may cover the lower end of the interior space 21. The cover fin 100 may cover the interior space 21 to prevent the combustion gas that flows in the interior of the heat exchanger 1 from bypassing (out of FIG. 7) downwards through the interior space 21.

Because the combustion gas is prevented from bypassing, the combustion gas may transfer heat to the heating medium (e.g. the heating water). Because sufficient heat is supplied to the heat medium without bypass, an efficiency of the heat exchanger 1 may increase.

Furthermore, damage to the first heat fin 31 and damage to surrounding components due to the bypass of the combustion gas may be prevented. A durability of the heat exchanger 1 may increase.

Figure 8:
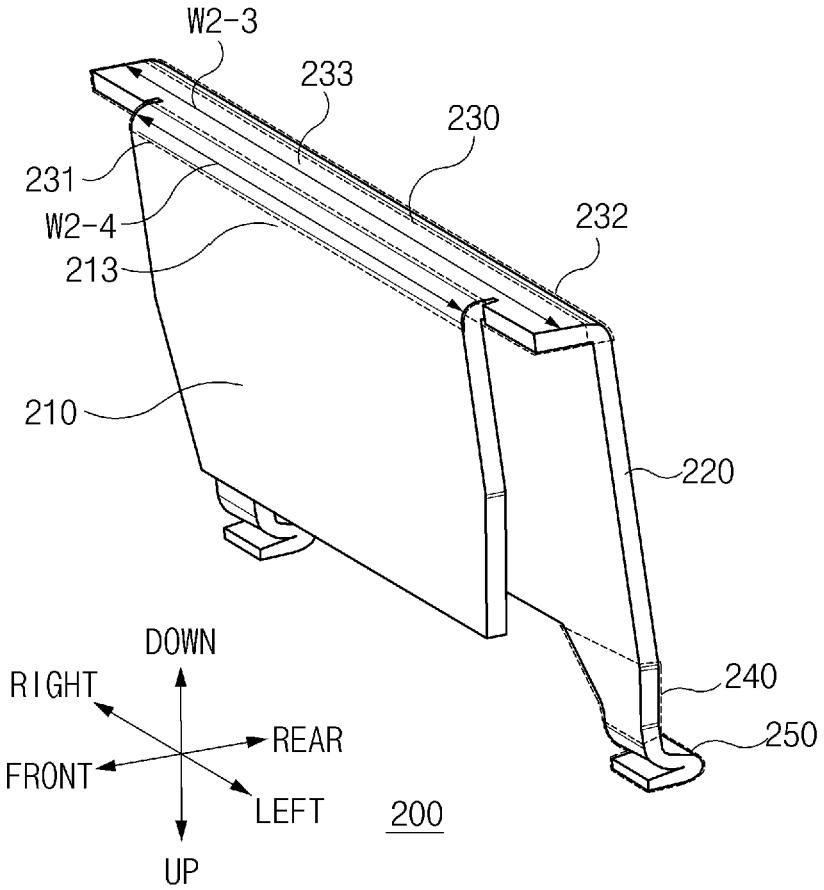
FIG. 8 is a perspective view of a cover fin according to a second embodiment.

FIG. 8 is a perspective view of a cover fin according to a second embodiment.

Figure 9:
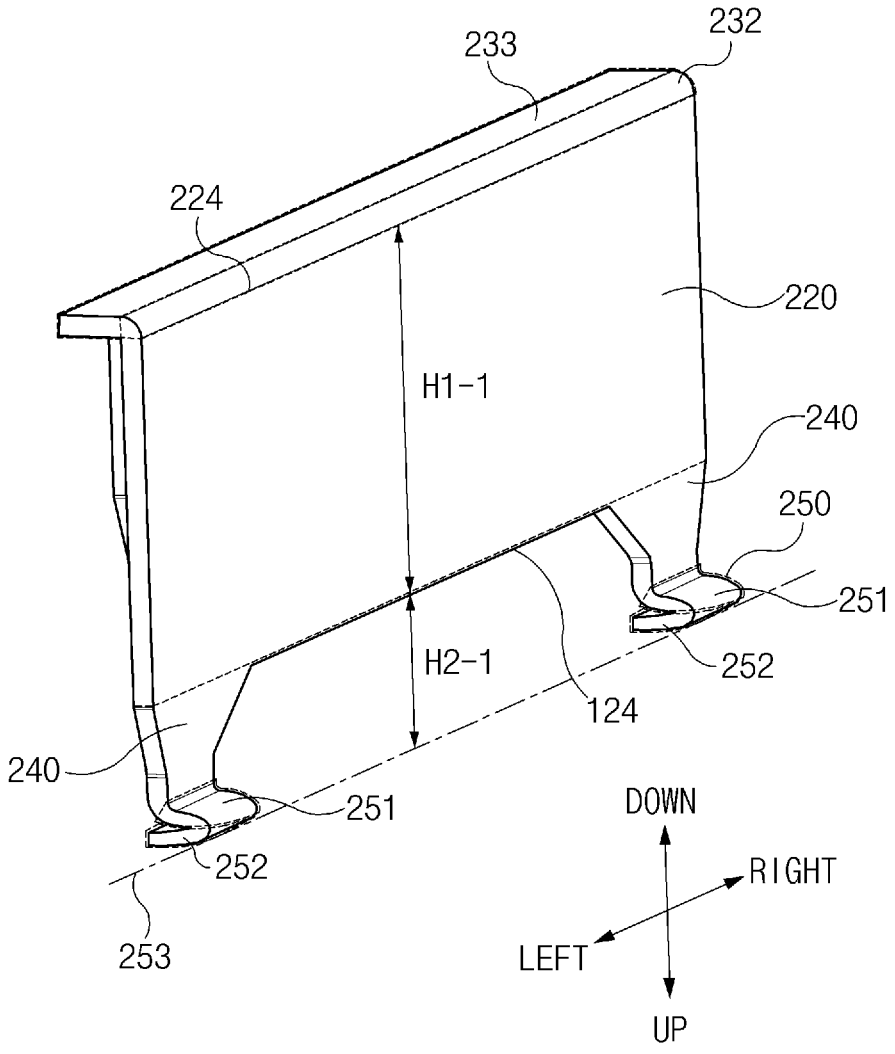
FIG. 9 is a perspective view of the cover fin of FIG. 8, viewed from another direction.

FIG. 9 is a perspective view of the cover fin of FIG. 8, viewed from another direction.

Figure 10:
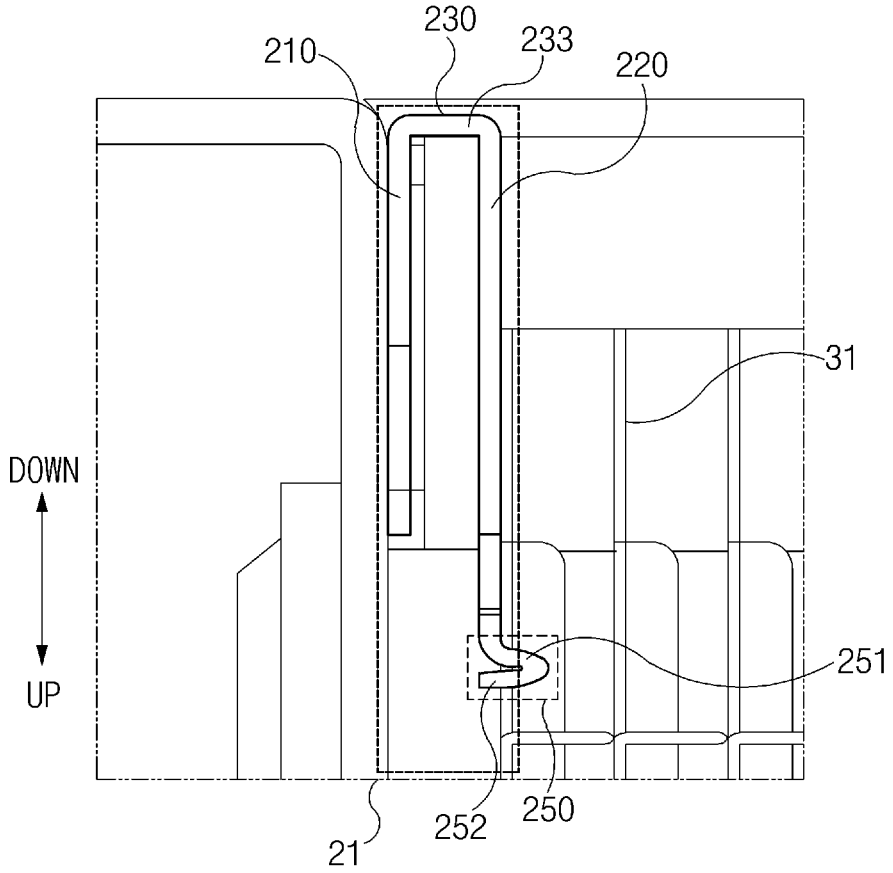
FIG. 10 is a view illustrating the cover fin of FIG. 8 disposed in an interior of a heat exchanger.

FIG. 10 is a view illustrating the cover fin of FIG. 8 disposed in the interior of the heat exchanger.

The cover fin 200 illustrated in FIGS. 8 to 10 may be formed partially differently from the cover fin 100 illustrated in FIGS. 4 to 5.

Connecting Part 230

For example, the connecting part 230 illustrated in FIGS. 8 to 10 may be partially formed in a flat shape, unlike the connecting part 130 illustrated in FIGS. 4 and 5.

The connecting part 230 that extends from a lower end 213 of a front part 210 and the lower end of a rear part 220 may have a curved part and another part that is flat.

For example, a first area 231 of the connecting part 230 and the lower end 213 of the front part 210 may be curved and to be connected to each other, and a second area 232 of the connecting part 230 and the lower end 213 of the front part 210 are curved and to be connected to each other.

A flat third area 233 may be formed between the first area 231 of the connecting part 230 and the second area 232 of the connecting part 230. The flat third area 233 may be connected to the front part 210 by the first area 231 and may be connected to the rear part 220 by the second area 232.

A (2-3)-th width W2-3 of the second area 232 and the third area 233 of the connecting part 230 in the leftward/rightward direction may be greater than a (2-4)-th width W2-4 of the first area 231. For example, because the (2-3)-th width W2-3 is formed to be greater than the (2-4)-th width W2-4, a step may be formed between the side surface of the first area 231 and the side surface of the third area 233.

Because the step is formed between the side surface of the third area 233 and the side surface of the first area 231, the user may easily remove the cover fin 200 inserted into the interior space between the front plate 11 and the first heat fin 31 from the interior space 21. For example, because the step is formed, the user may easily remove the cover fin 100 from the interior space 21 by pinching an area, in which the step is formed, by using a tool, such as tweezers or pliers.

Referring to FIG. 10, the connecting part 230 includes the third area 233 whereby the entire front part 210 may contact the front plate 11 when the cover fin 200 is disposed in the interior space 21.

Because the connecting part 230 includes the third area 233, a larger area of the rear part 220 may contact the first heat fin 31 in the cover fin 200 of FIG. 8 than in the cover fin 100 of FIG. 4.

Because the entire front part 210 contacts the front plate 11, and a larger area of the rear part 220 contacts the first heat fin 31, the cover fin 200 may be air-tightened more tightly than the cover fin 100 including the connecting part 130 having a curved surface.

Protrusion 250

The protrusion 250 illustrated in FIGS. 8 to 10 may be formed differently from the protrusion 150 in FIGS. 4 to 5. The protrusion 250 according to the embodiment of FIGS. 8 and 9 may include a first protruding area 251 and a second protruding area 252.

The first protruding area 251 may be formed to be curved toward the rear side at the upper end of a leg part 240. For example, the first protruding area 251 may connect the leg part 240 and the second protruding area 252.

The second protruding area 252 may be formed to be curved toward the front side from the upper end of the first protruding area 251. For example, the second protruding area 252 may be formed to be curved toward the front side at the upper end of the first protruding area 251, which is opposite to the lower end of the first protruding area 251 connected to the leg part 240.

A portion of the first protruding area 251 and a portion of the second protruding area 252 may be inserted into the hole 32 of the first heat fin 31. Because the portion of the first protruding area 251 and the portion of the second protruding area 252 is inserted into the hole of the first heat fin 31, the cover fin 100 may be fixed to the first heat fin 31.

A height from a lower end 223 of the rear part 220 to an upper end 224 of the rear part 220 may be a (1-1)-th height H1-1. A height from the upper end 224 of the rear part 220 to an upper end 253 of the protrusion 250 may be a (2-1)-th height H2-1.

Figure 11:
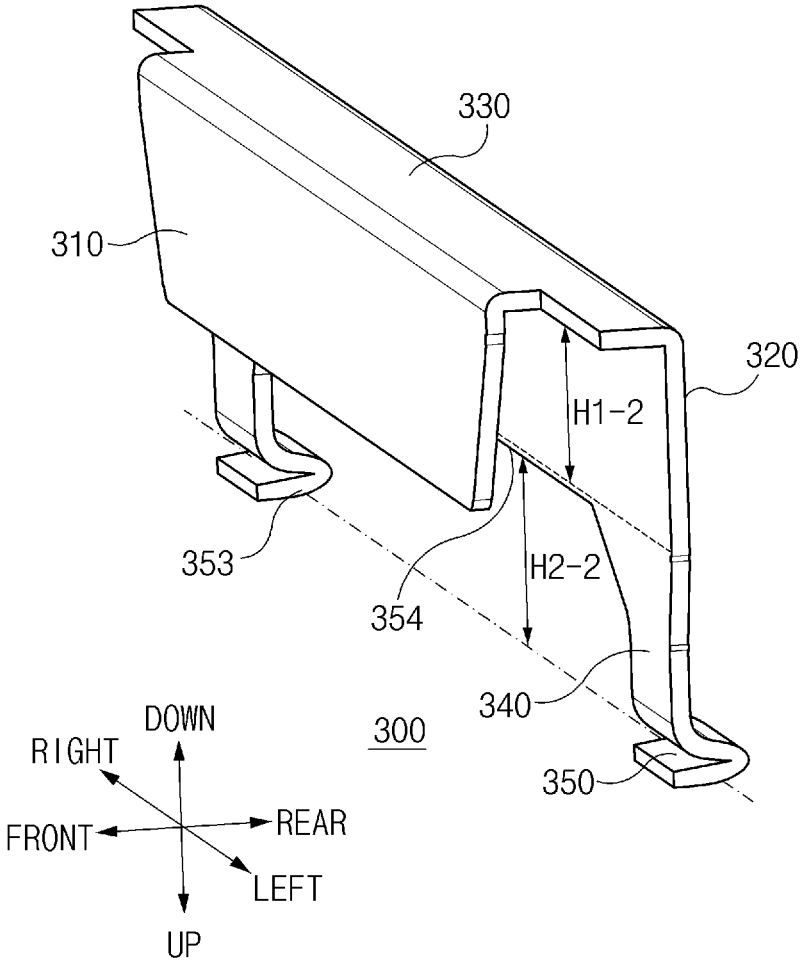
FIG. 11 is a perspective view of a cover fin according to a third embodiment.

FIG. 11 is a perspective view of a cover fin according to a third embodiment.

Figure 12:
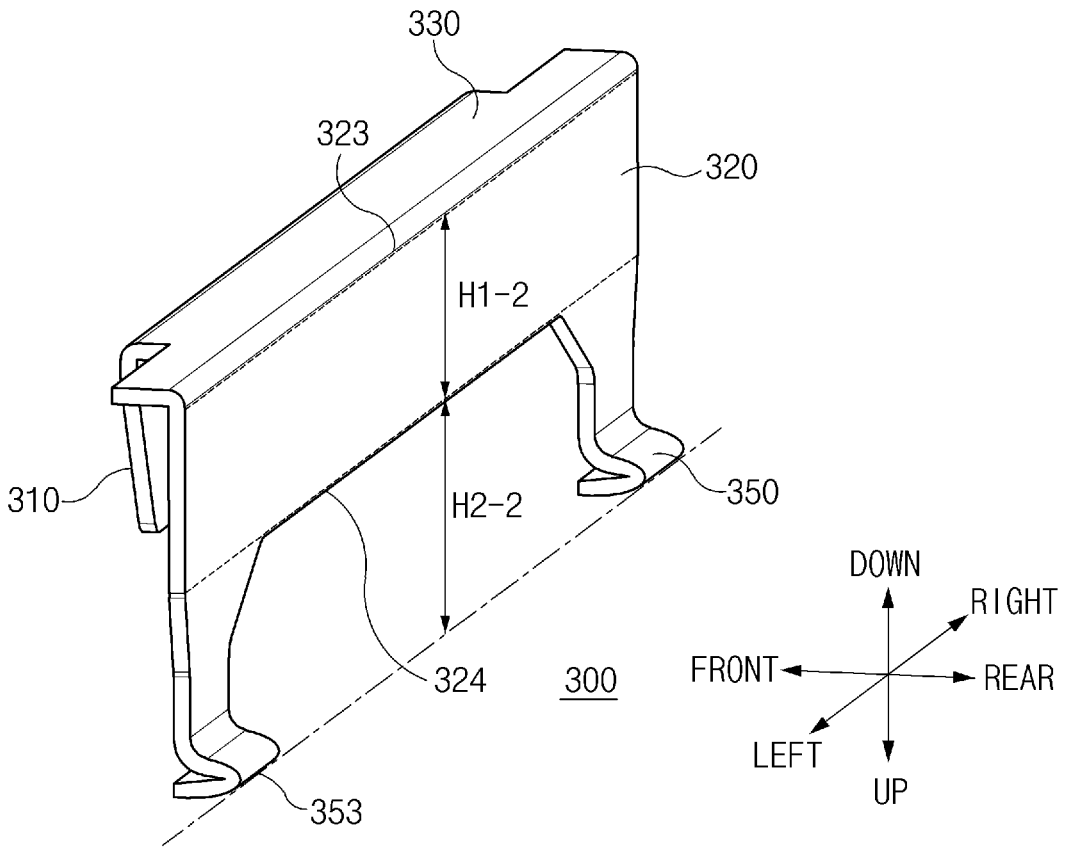
FIG. 12 is a perspective view of the cover fin of FIG. 11, viewed from another direction.

FIG. 12 is a perspective view of the cover fin of FIG. 11, viewed from another direction.

A cover fin 300 illustrated in FIGS. 11 and 12 may be formed partially differently from the cover fin 200 illustrated in FIGS. 8 to 10. Portions of the cover fins 100 and 200 illustrated in FIGS. 4 to 10 may be referenced for the cover fin 300 illustrated in FIGS. 11 and 12. For example, the cover fin 300 may include a front part 310, a rear part 320, a connecting part 330, a leg part 340, and a protrusion 350.

The leg part 340 of the cover fin 300 may have a different height from that of the leg part 240 of the cover fin 200 of FIGS. 8 and 9.

A height from a lower end 323 of the rear part 320 to an upper end 324 of the rear part 320 may be a (1-2)-th height H1-2. A height from the upper end 324 of the rear part 320 to an upper end 353 of the protrusion 350 may be a (2-2)-th height H2-2.

The (1-2)-th height H1-2 may be substantially the same as the (1-1)-th height H1-1 of FIG. 9.

The (1-1)-th height H1-1 and the (1-2)-th height H1-2 of FIG. 9 may be formed by a distance from the lower end of the first heat fin 31 to the plurality of heat exchange pipelines 20.

Because the (1-1)-th height H1-1 and the (1-2)-th height H1-2 are formed by the distance from the lower end of the first heat fin 31 to the plurality of heat exchange pipelines 20, the upper end 324 of the rear part 320 may contact the lower ends of the plurality of heat exchange pipelines 20 when the cover fin 300 is inserted into the interior space 21. For example, when the cover fin 300 is inserted into the interior space 21, the upper end 324 of the rear part 320 may be stopped by the lower ends of the plurality of heat exchange pipelines 20.

Because the upper end 324 of the rear part 320 is stopped by the lower ends of the plurality of heat exchange pipelines 20, an insertion depth of the cover fin 300 may be limited. Because the cover fin 300 is prevented from being disposed deep in the interior space 21 as the insertion depth is limited, the user may easily remove the cover fin 300 from the interior space. Because the cover fin 300 is easily removed, maintenance of the heat exchanger 1 through the interior space 21 may be facilitated.

The leg part 340 of the cover fin 300 may be formed to be longer than the leg part 240 of the cover fin 200 of FIGS. 8 and 9. For example, the (2-2)-th height H2-2 of the cover fin 300 may be longer than the (2-1)-th height H2-1 of the cover fin 200 of FIG. 9. As the length of the leg part 340 increases, the protrusion 350 that extends from the leg part 340 may be inserted into the hole 32 even through the hole 32 in the first heat fin 31 is formed deep in the interior space 21. For example, a plurality of holes 32 may be formed on the first heat fin 31 depending on the depth. As the leg part 340 is formed longer, the protrusion 350 of the cover fin 300 may be selectively inserted into the plurality of holes 32.

Figure 13:
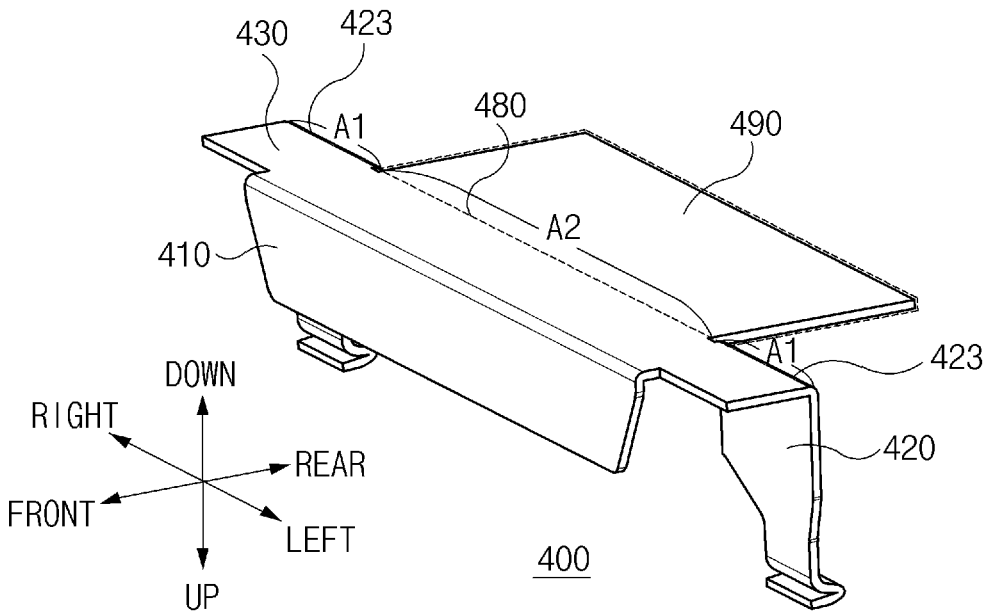
FIG. 13 is a perspective view of a cover fin according to a fourth embodiment.

FIG. 13 is a perspective view of a cover fin according to a fourth embodiment.

Figure 14:
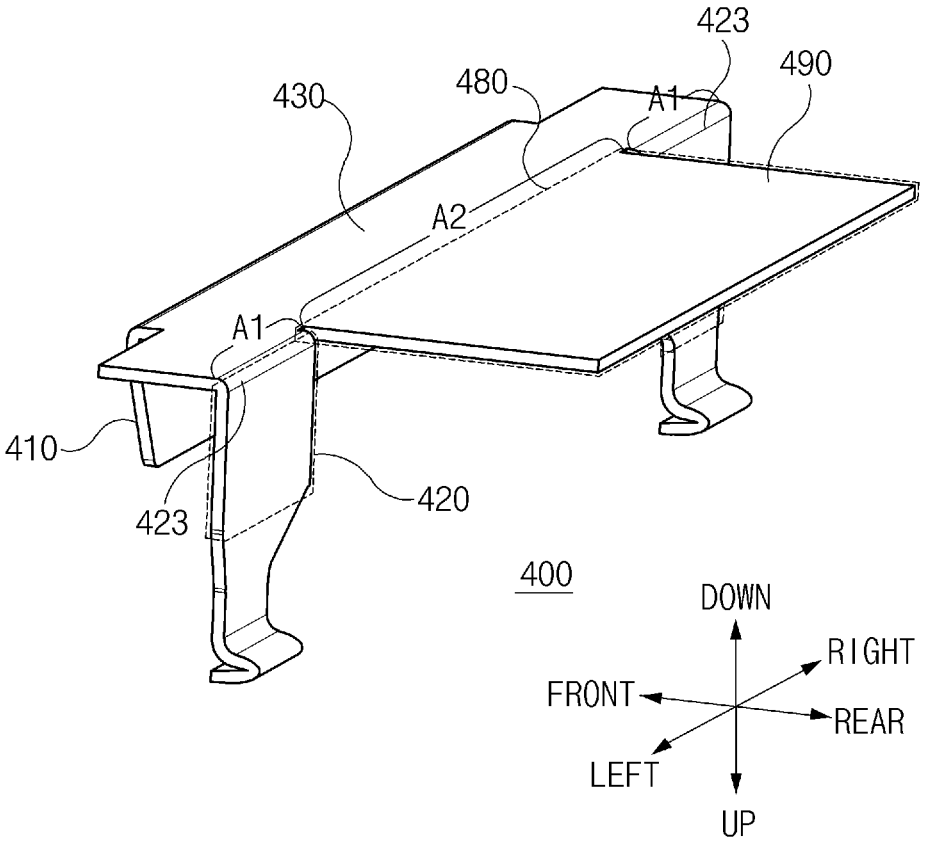
FIG. 14 is a perspective view of the cover fin of FIG. 13, viewed from another direction.

FIG. 14 is a perspective view of the cover fin of FIG. 13, viewed from another direction.

A cover fin 400 illustrated in FIGS. 13 and 14 may further include a cover part 490.

A portion of the cover fins 100, 200, and 300 of FIGS. 4 to 12 described above may be reference for the cover fin 400. For example, the front part 110, the rear part 120, and the connecting part 130 of the cover fin 100 may be referenced for a front part 410, a rear part 420, and a connecting part 430 of the cover fin 400.

The cover part 490 may extend rearward from a portion of the connecting part 430. For example, the connecting part 430 may be connected to a lower end 423 of the rear part 420 in a partial area A1 of a first periphery 480. The cover part 490 may extend rearward to another area A2 other than the partial area A1 connected to the lower end of the rear part 420.

The cover part 490 may cover the lower ends of the plurality of heat fins 30 when the cover fin 400 is disposed in the interior space 21. For example, the cover part 490 may extend from the connecting part 430 to the lower ends of the plurality of heat fins 30.

As the cover part 490 is disposed, the combustion gas may be prevented from bypassing rearward through the interior space 21. For example, the cover part 490 covers the spaces between the plurality of heat fins 30, the combustion gas may be prevented from bypassing between the plurality of heat fins 30.

Figure 15:
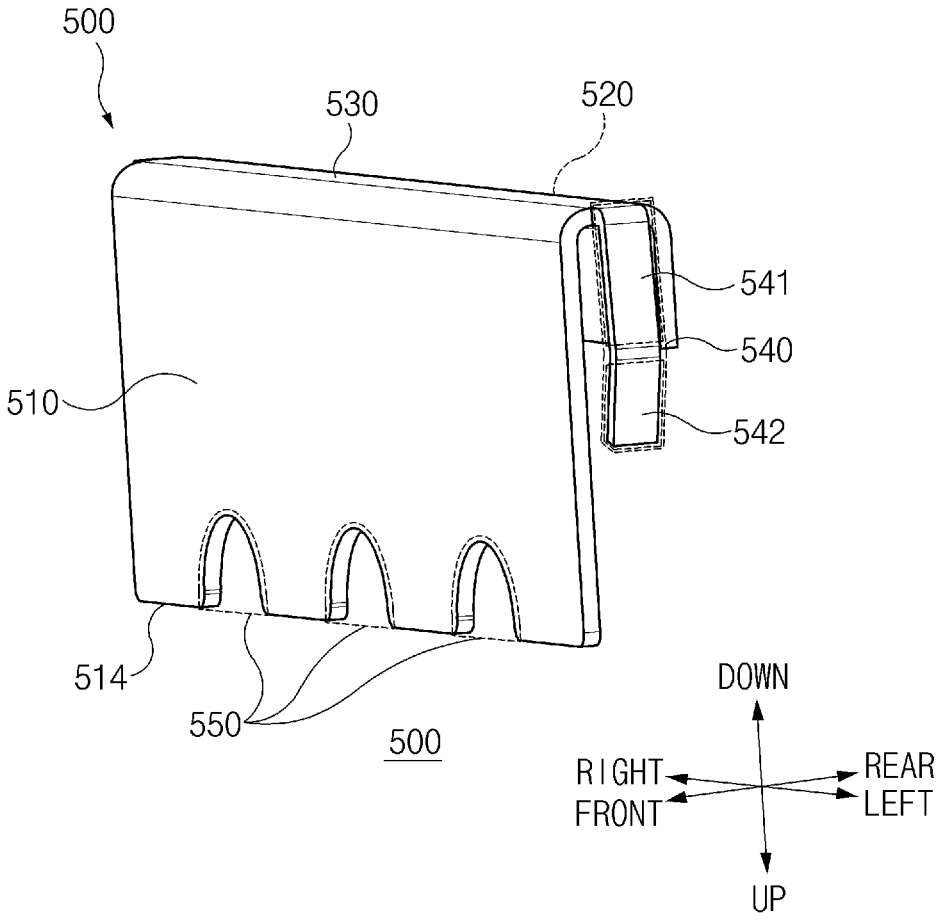
FIG. 15 is a perspective view of a cover fin according to a fifth embodiment.

FIG. 15 is a perspective view of a cover fin according to a fifth embodiment.

Figure 16:
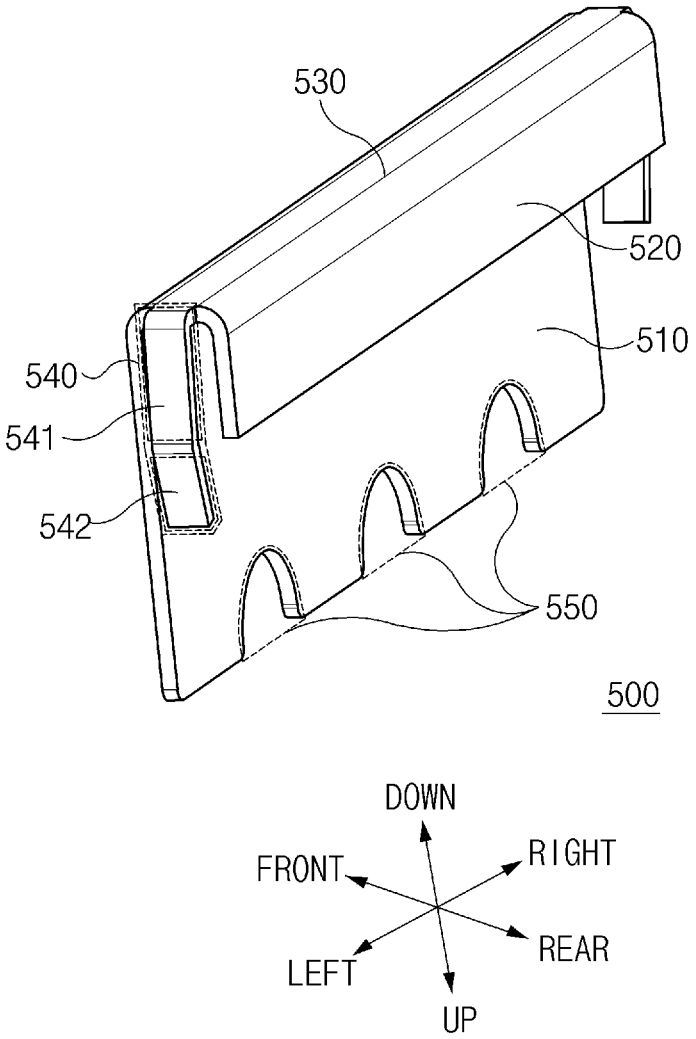
FIG. 16 is a perspective view of the cover fin of FIG. 15, viewed from another direction.

FIG. 16 is a perspective view of the cover fin of FIG. 15, viewed from another direction.

Figure 17:
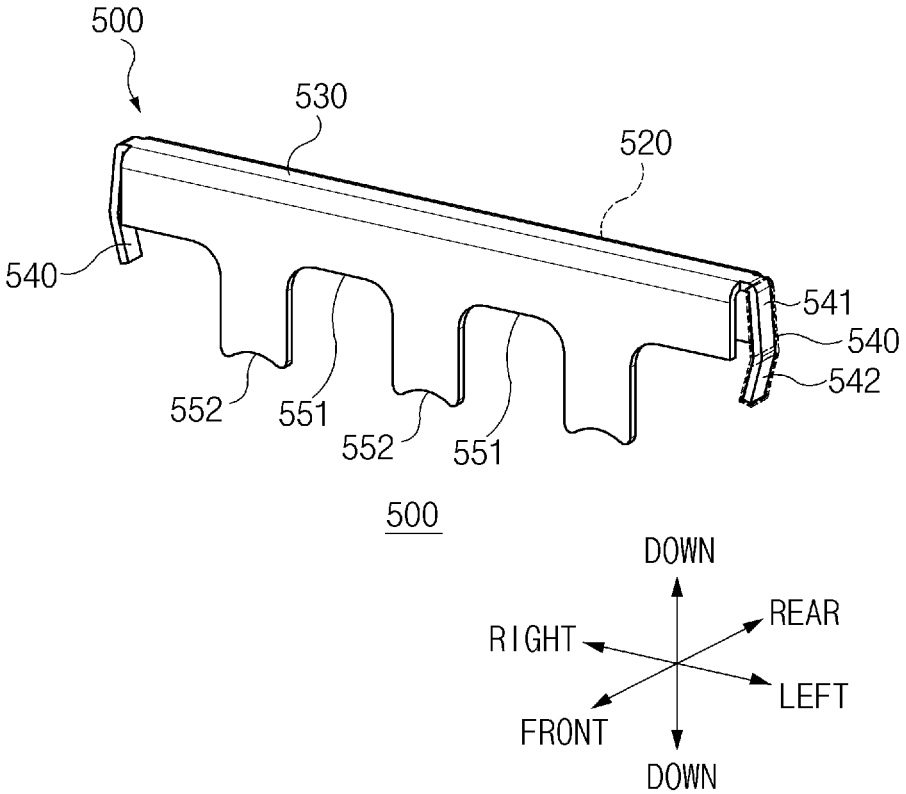
FIG. 17 is a perspective view of a cover fin according to a sixth embodiment.

FIG. 17 is a perspective view of a cover fin according to a sixth embodiment.

Figure 18:
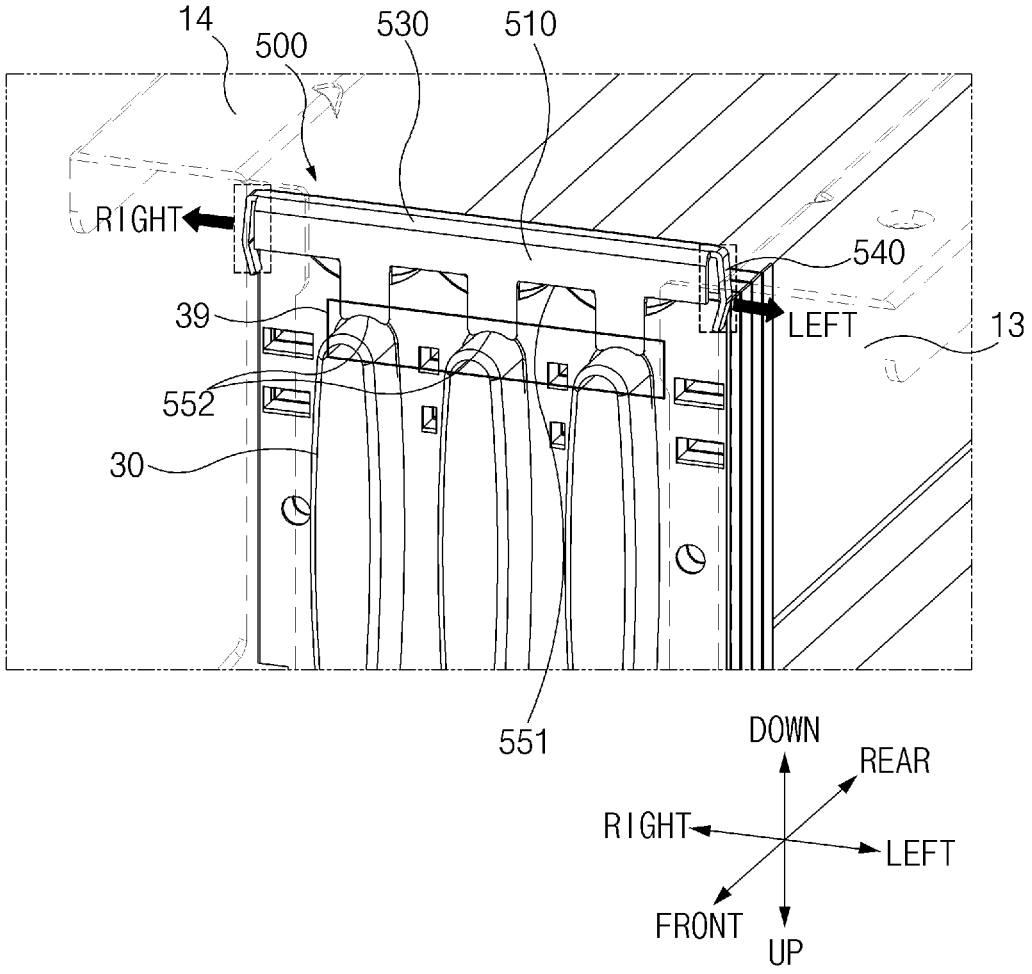
FIG. 18 is a view illustrating the cover fin of FIG. 17 disposed in an interior of a heat exchanger.

FIG. 18 is a view illustrating the cover fin of FIG. 17, which is disposed in the interior of the heat exchanger.

A cover fin 500 of FIGS. 15 to 18 excludes the leg part and the protrusion unlike the cover fins 100, 200, 300, and 400 of FIGS. 4 to 14, and may include a wing part 540.

The cover fins 100, 200, 300, and 400 of FIGS. 4 to 14 may be partially referenced for the cover fin 500 of FIGS. 15 to 18. For example, the cover fin 500 of FIGS. 15 and 18 may include a front part 510, a rear part 520, and a connecting part 530. For example, the front part 510 may face the front side, the rear part 520 may face the rear surface, the connecting part 530 may be curved from the front part 510 and the rear part 520 to connect the front part 510 and the rear part 520.

Wing Part 540

The cover fin 500 may further include the wing part 540.

The wing part 540 may protrude from a side surface of the connecting part 530 in the leftward/rightward direction. For example, the wing part 540 may protrude upward from a side surface of the connecting part 530 in the leftward/rightward direction, which is not connected to the front part 510 and the rear part 520.

The wing part 540 may include a first wing area 541 and a second wing area 542.

The first wing area 541 may extend upward from the side surface of the connecting part 530. For example, the first wing area 541 may extend from the side surface of the connecting part 530 toward an outside of the cover fin 500 in the leftward/rightward direction with respect to the upper side. For example, the first wing area 541 may extend from the side surface of the connecting part 530 toward the outside of the connecting part 530 in the leftward/rightward direction with respect to the upper side.

The second wing area 542 may extend upward from the first wing area 541. For example, the second wing area 542 may extend from the first wing area 541 toward an inside of the cover fin 500 in the leftward/rightward direction with respect to the upper side. For example, the second wing area 542 may extend from one point of the first wing area 541 toward the inside of the cover fin 500.

The wing part 540 may extend outward toward the upper side and then be curved inward and extend. For example, when the cover fin 500 is viewed from the front side or the rear side, a point, at which the first wing area 541 and the second wing area 542 are connected to each other, may protrude from the cover fin 500. For example, when viewed from the front side, cross sections of the wing parts 540 on opposite side surfaces thereof may be formed in "<" and ">" shapes. Because the wing part 540 is formed, the cover fin 500 may be easily coupled between the side plates 13 and 14. For example, the cover fin 500 disposed between the side plates 13 and 14 by the connecting portions of the protruding first wing area 541 and the second wing area 542 may be fixed in between the side plates 13 and 14.

Because the second wing area 542 is formed to be inclined toward the inside of the cover fin 500, the cover fin 500 may be easily inserted into the side plates 13 and 14 in spite of the protruding connection portions. For example, when the cover fin 500 is inserted into the interior space 21, the cover fin 500 may be inserted while being slid along the inclined second wing area 542, and then the protruding connection portions may be fixed between the side plates 13 and 14 as the protruding connecting portions are stopped by the side plates 13 and 14. Referring to FIG. 18, when the cover fin 500 is disposed in the interior space 21, the wing parts 540 may contact the side plates 13 and 14. When the cover fin 500 is disposed in the interior space 21, a force is applied to the side plates 13 and 14 in the leftward/rightward direction while the wing parts 540 contact the side plates 13 and 14 whereby the cover fin 500 may be fixed between the side plates 13 and 14. For example, the protruding connecting portions of the first wing area 541 and the second wing area 542 apply a force to the side plates 13 and 14 in the leftward/rightward direction whereby the cover fin 500 may be fixed to the side plates 13 and 14. For example, the cover fin 500 may be fixed between the side plates 13 and 14 because the protruding connecting portions are stopped between the side plates 13 and 14 in the leftward/rightward direction. Because the cover fin 500 is fixed between the side plates 13 and 14 by the wing parts 540, the cover fin 500 that does not include the protrusion 150 may be fixed to the interior space. For example, referring to FIG. 18, the cover fin 500 may be fixed between the side plates 13 and 14 by applying a force in a direction, in which the wing parts 540 face the side plates 13 and 14.

Plurality of Grooves 550

A plurality of grooves 550 may be formed in the front part 510. For example, the plurality of grooves 550 that are recessed downward may be formed in an upper end 514 of the front part 510. The plurality of grooves 550 may be arranged along the leftward/rightward direction. For example, the plurality of grooves 550 may be arranged along the leftward/rightward direction at regular intervals.

The cover fin 500 illustrated in FIG. 17 has a slightly different shape from that of the cover fin 500 illustrated in FIGS. 15 and 16, but may perform substantially the same function. For example, the cover fin 500 of FIG. 17 may be fixed between the side plates 13 and 14 through the wing parts 540.

Referring to FIG. 17, the plurality of grooves 550 may include a plurality of (1-1)-th grooves 551 and a plurality of (1-2)-th grooves 552. The plurality of (1-1)-th grooves 551 may be formed along the leftward/rightward direction at the upper end 514 of the front part 510. The plurality of (1-2)-th grooves 552 may be formed between the plurality of (1-1)-th grooves 551.

The plurality of (1-1)-th grooves 551 may be recessed downward deeper than the plurality of (1-2)-th grooves 552.

The plurality of (1-2)-th grooves 552 may connect the plurality of different adjacent (1-1)-th grooves 551. For example, one of the plurality of (1-2)-th grooves 552 may connect one end of one of the plurality of (1-1)-th grooves 551 and one end of another (1-1)-th groove. For example, the plurality of (1-1)-th grooves 551 and the plurality of (1-2)-th grooves 552 may be formed continuously at the upper end 514 of the front part 510.

Referring to FIG. 18, some of the plurality of grooves 550 may contact the plurality of heat exchange pipelines 20. For example, the plurality of heat exchange pipelines 20 may pass through the plurality of (1-2)-th grooves 552. For example, the plurality of (1-2)-th grooves 552 may contact the lower ends 39 of the plurality of heat exchange pipelines 20. For example, the plurality of (1-2)-th grooves 552 may support the lower ends of the plurality of heat exchange pipelines 20.

The plurality of (1-2)-th grooves 552 may support the lower ends of the plurality of heat exchange pipelines 20 to limit a depth, at which the cover fin 500 is inserted. For example, the cover fin 500 may be prevented from being disposed deep in the interior space 21 as the (1-2)-th grooves 552 contact the lower ends of the plurality of heat exchange pipelines 20.

Because the cover fin 500 is prevented from being disposed deep in the interior space 21, the cover fin 500 may be disposed at the lower end of the interior space 21.

Because the plurality of heat exchange pipelines 20 are inserted into the plurality of (1-2)-th grooves 552, the cover fin 500 may be fixed to the plurality of heat exchange pipelines 20. Because the cover fin 500 is fixed to the plurality of heat exchange pipelines 20, the cover fin 500 may be stably disposed in the interior space 21.

Figure 19:
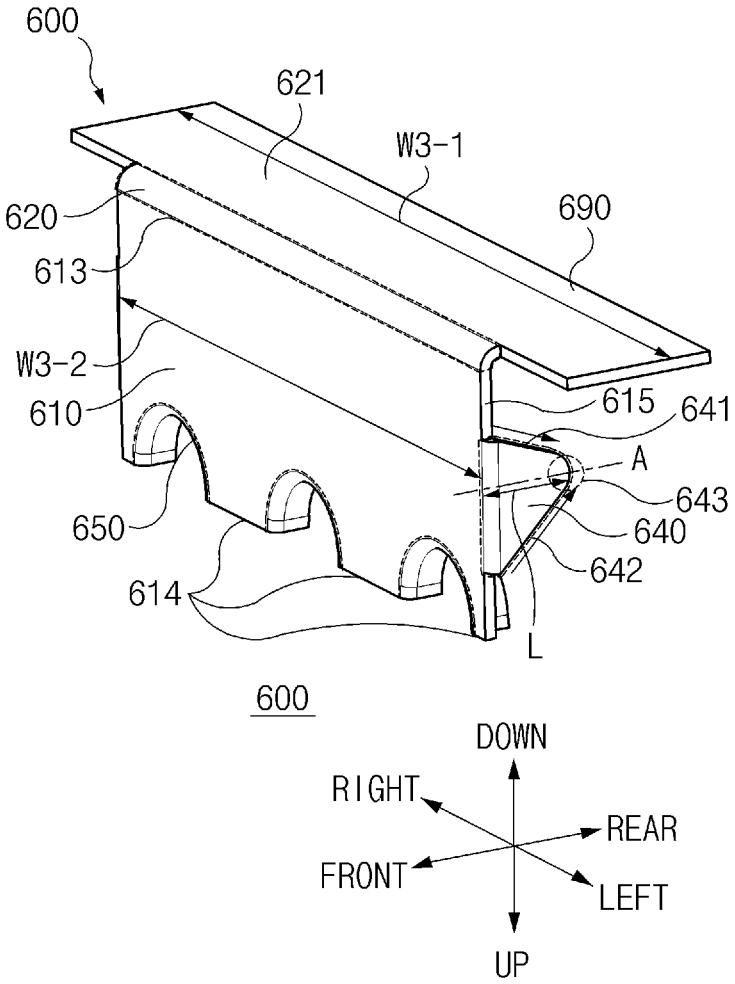
FIG. 19 is a perspective view of a cover fin according to a seventh embodiment.

FIG. 19 is a perspective view of a cover fin according to a seventh embodiment.

Figure 20:
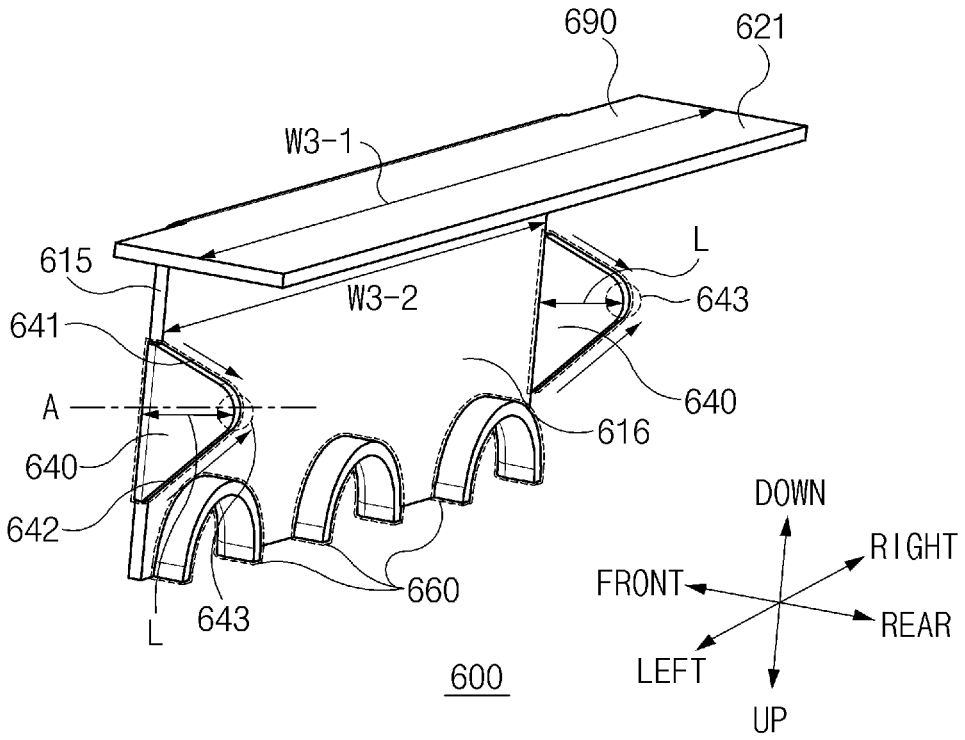
FIG. 20 is a perspective view of the cover fin of FIG. 19, viewed from another direction.

FIG. 20 is a perspective view of the cover fin of FIG. 19, viewed from another direction.

A cover fin 600 of FIGS. 19 and 20 may exclude the connecting part and rear part, and may include a cover part 690 and an insertion part 640.

The cover fins 100, 200, 300, 400, and 500 of FIGS. 4 to 18 may be referenced for the cover fin 600. For example, the cover fin 600 may include a front part 610 referring to the front parts 110, 210, 310, 410, and 510 of FIGS. 4 to 19. For example, the front part 610 may be defined by one area that is perpendicular to the forward/rearward direction. For example, a plurality of grooves 650 that are recessed downward may be formed in an upper end 614 of the front part 610.

Cover Part 690

The cover fin 600 may include the cover part 690.

The cover part 690 may extend rearward from a lower end 613 of the front part 610. The cover part 690 may include a cover part connecting area 620 that is connected to the front part 610, and a cover area 621 that extends rearward from the cover part connecting area 620. The cover part connecting area 620 may be curved at a lower end of the front part 610 and may be connected to the cover area 621.

In the cover part 690, a width of the cover area 621 in the leftward/rightward direction may be greater than a width of the front part 610 in the leftward/rightward direction. For example, the cover area 621 may have a (3-1)-th width W3-1 in the leftward/rightward direction, and the front part 610 may have a (3-2)-th width W3-2 in the leftward/rightward direction. The (3-1)-th width W3-1 may be greater than the (3-2)-th width W3-2.

The cover part 690 may cover the lower ends of the plurality of heat fins 30 when the cover fin 600 is disposed in the interior space 21. Because the cover part 690 covers the lower ends of the plurality of heat fins 30, the cover fin 600 may prevent the combustion gas from bypassing through not only the interior space 21 but also the spaces formed between the plurality of heat fins 30.

Insertion Part 640

The cover fin 600 may include the insertion part 640. Because one point 643 of the insertion part 640 contacts the first heat fin 31, the cover fin 600 may be fixed to the first heat fin 31.

The insertion part 640 may protrude from a portion of the front part 610. For example, the insertion part 640 may protrude rearward from a portion of the front part 610, which is located on an upper side of the cover part 690. For example, the insertion part 640 may protrude toward the rear side from a side surface 615 of the front part 610, which is located on the upper side of the cover part 690.

The insertion part 640 may include a lower boundary 641 and an upper boundary 642.

The lower boundary 641 may extend from an area of the side surface 615 of the front part 610, which is adjacent to the cover part 690. For example, the lower boundary 641 may extend upward toward the rear side from the side surface of the front part 610, which is adjacent to the cover part 690, in the upward/downward direction. For example, the lower boundary 641 may be inclined upward and extend from the side surface of the front part 610 toward an axis (e.g., axis "A") that passes through the insertion part 640.

The upper boundary 642 may extend from an area of the side surface 615 of the front part 610, which is adjacent to the plurality of grooves 650. For example, the upper boundary 642 may extend downward toward the rear side from the side surface 615 of the front part 610, which is adjacent to the plurality of grooves 650, in the upward/downward direction. For example, the lower boundary 641 may be inclined downward and extend from the side surface of the front part 610 toward an axis (e.g., axis "A") that passes through the insertion part 640.

Due to the lower boundary 641 and the upper boundary 642 of the insertion part 640 that extends while being inclined toward the rear side, the width of the insertion part 640 in the upward/downward direction may gradually decrease toward the rear side.

The lower boundary 641 and the upper boundary 642 may meet each other at one point 643. It is described that the one point is an example, but the present disclosure is not limited thereto. One point 643 may be one area. The one point 643 may contact the first heat fin 31. For example, an extension length "L" of the insertion part 640 from a front surface of the front part 610 to the one point 643 may be greater than or substantially the same as a length of the interior space 21 between the first heat fin 31 and the front plate 11 in the forward/rearward direction. Because the extension length "L" of the insertion part 640 is greater than or substantially the same as the length of the interior space 21 in the forward/rearward direction, the cover fin 600 may be inserted between the first heat fin 31 and the front plate 11.

Because the cover fin 600 is inserted between the first heat fin 31 and the front plate 11, the cover fin 600 may be fixed to the interior space 21. The cover fin 600 may be stably disposed in the interior space 21.

When viewed from the leftward/rightward direction, a cross section of the insertion part 640 may be formed in a triangular shape, but the present disclosure is not limited thereto.

Because the side surface of the insertion part 640 is formed in an inclined shape, the cover fin 600 may be easily inserted and separated between the first heat fin 31 and the front plate 11 even when the extension length "L" is greater than the length of the interior space 21 in the forward/rearward direction.

For example, because the upper boundary 642 of the insertion part 640 is formed in a shape that is inclined toward the rear side, the cover fin 600 may be slid along the inclined upper boundary 642, and may be inserted between the first heat fin 31 and the front plate 11.

For example, because the lower boundary 641 of the insertion part 640 is formed in the shape that is inclined toward the rear side, the cover fin 600 may be slid along the inclined lower boundary 641 and may be easily separated between the first heat fin 31 and the front plate 11.

Flange Part 660

A plurality of flange parts 660 may be formed on the cover fin 600.

The flange parts 660 may be formed on a rear surface 616 of the front part 610. For example, the flange parts 660 may be formed on the rear surface 616 of the front part 610, which is adjacent to the upper end 614 of the front part 610.

The flange part 660 may be formed around the plurality of grooves 650. For example, the flange part 660 may be formed along peripheries of the plurality of grooves 650. For example, the flange part 660 may protrude rearward from the upper end 614 of the rear surface 616 while surrounding the plurality of grooves 650.

The plurality of heat exchange pipelines 20 may be seated on the flange part 660. For example, the lower ends of the plurality of heat exchange pipelines 20 may be inserted into the plurality of grooves 650 and may be seated on the flange part 660.

Because the plurality of heat exchange pipelines 20 are seated on the flange part 660, the insertion depth of the cover fin 600 may be limited.

For example, because the flange parts 660 contact the lower ends of the plurality of heat exchange pipelines 20, the cover fin 600 may be prevented from being disposed deep in the interior space 21. Because the cover fin 600 is prevented from being disposed deep in the interior space 21, the cover fin 600 may be disposed at the lower end of the interior space 21. Because the flange parts 660 are formed, a strength of the front part 610 may be stronger than that of the front part without a flange.

Figure 21:
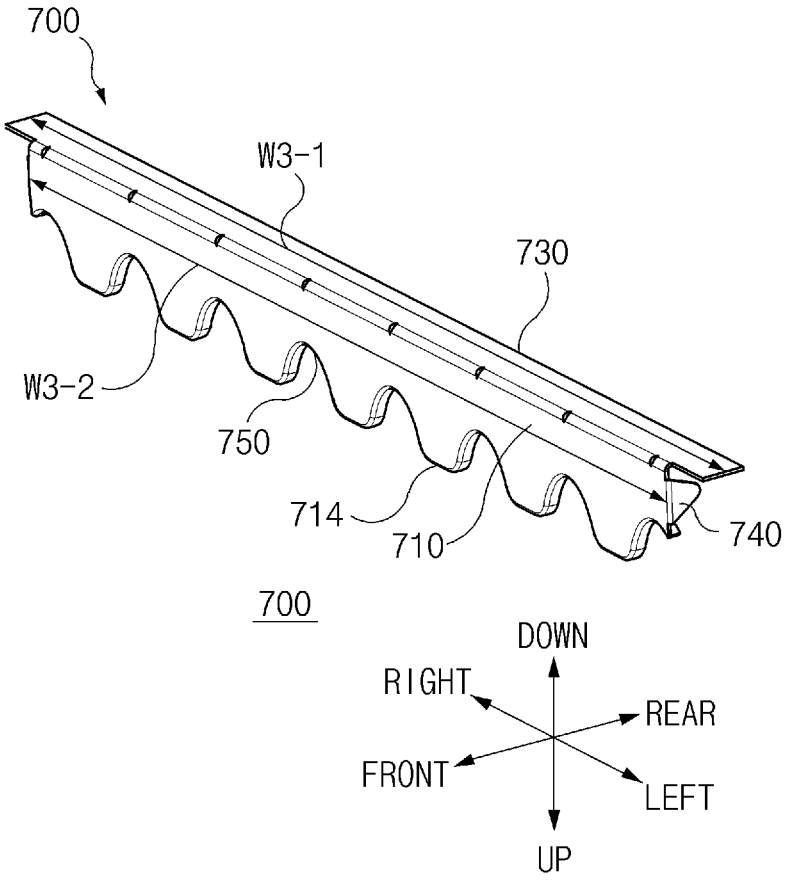
FIG. 21 is a perspective view of a cover fin according to an eighth embodiment.

FIG. 21 is a perspective view of a cover fin according to an eighth embodiment.

Figure 22:
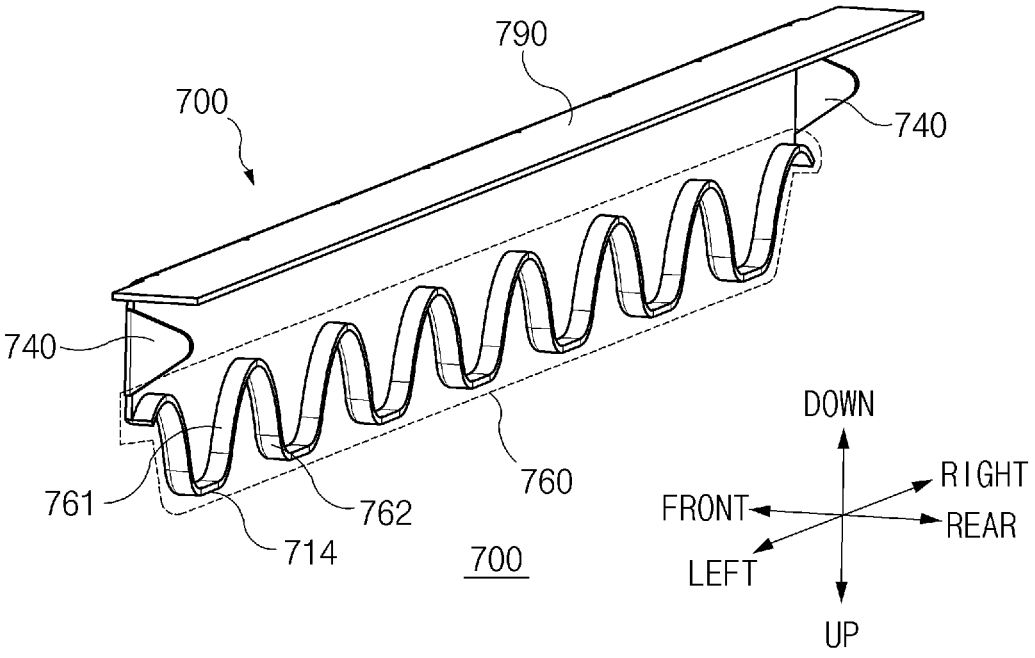
FIG. 22 is a perspective view of the cover fin of FIG. 21, viewed from another direction.

FIG. 22 is a perspective view of the cover fin of FIG. 21, viewed from another direction.

Figure 23:
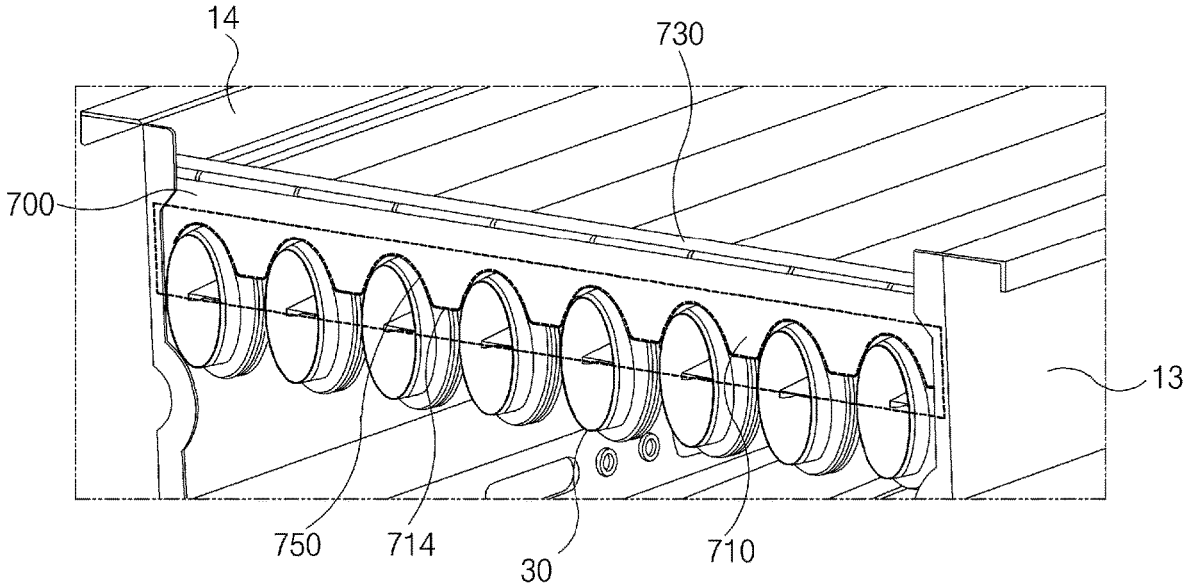
FIG. 23 is a view illustrating the cover fin of FIG. 21 disposed in an interior of a heat exchanger.

FIG. 23 is a view illustrating the cover fin of FIG. 21, which is disposed in the interior of the heat exchanger.

The cover fin 600 of FIGS. 19 and 20 may be referenced for the cover fin 700 of FIGS. 21 to 23. For example, the front part 610, the cover part 690, and the insertion part 640 of the cover fin 600 of FIGS. 19 and 20 may be referenced for a front part 710, a cover part 790, and an insertion part 740 of the cover fin 700.

The plurality of heat exchange pipelines 20 may be inserted into a plurality of grooves 750 formed in the cover fin 700 of FIGS. 21 to 23.

The number of the plurality of grooves 750 may correspond to the number of the plurality of heat exchange pipelines 20. The shape of the plurality of grooves 750 may be formed to correspond to the peripheries of the plurality of heat exchange pipelines 20.

Because the plurality of heat exchange pipelines 20 are inserted into the plurality of grooves 750, the cover fin 700 may be fixed to the plurality of heat exchange pipelines 20. Because the insertion part 740 and the plurality of grooves 750 are formed, the cover fin 700 may be fixed more strongly in the interior space than when the insertion part 740 and the plurality of grooves 750 are not formed.

A flange part 760 of the cover fin 700 of FIGS. 21 and 22 may extend to an area other than an area, in which the plurality of grooves 750 are formed. For example, the flange part 760 may extend from the inner surface of the front part 710 to an area other than the vicinity of the plurality of grooves 750 and to the vicinity of the plurality of grooves 750. For example, the flange part 760 may be formed overall at an upper end 714 of the front part 710. For example, the flange part 760 may include a plurality of groove flanges 761 that surround the plurality of grooves 750, and at least one connecting flange 762 that connects the plurality of groove flanges 761. The flange part 760 may be formed overall at the upper end 714 of the front part 710 by the plurality of groove flanges 761 and the at least one connecting flange 762.

The plurality of heat exchange pipelines 20 may be seated on the flange part 760. For example, the lower ends of the plurality of heat exchange pipelines 20 may be inserted into the plurality of grooves 650 and may be seated on the flange part 760. Because the plurality of heat exchange pipelines 20 are seated on the flange part 760, the insertion depth of the cover fin 700 may be limited. For example, because the plurality of heat exchange pipelines 20 are seated on the flange part 760, they may be prevented from being disposed deep in the interior space 21. Because the plurality of heat exchange pipelines 20 are prevented from being disposed deep in the interior space 21, the cover fin 700 may be disposed at the lower end of the interior space 21.

Because the flange part 760 includes the plurality of groove flanges 761 and the connecting flanges 762, a strength of the upper end 714 of the front part 710 may be secured.

It has been described as an example that the above-described cover fins 100, 200, 300, 400, 500, 600, and 700 are formed as different cover fins, but the present disclosure are not limited thereto. The cover fins may be combined with each other. For example, the plurality of grooves 550, 650, and 750 may be formed in the front part 110 of the cover fin 100. For example, the wing part 540 may be additionally formed on the connecting part 130 of the cover fin 100, and insertion parts 640, 740 may be additionally formed on the front part 110.

It has been described as an example that the above-described cover fins 100, 200, 300, 400, 500, 600, and 700 are configured to be disposed in the interior space 21 between the first heat fin 31 and the front plate 11, but the locations of the cover fins 100, 200, 300, 400, 500, 600, and 700 are not limited thereto. The cover fins 100, 200, 300, 400, 500, 600, and 700 also may be disposed in the interior space 21 between the second heat fin 33 and the rear plate 12 to prevent the combustion gas from bypassing through the interior space 21.

The above-described cover fins 100, 200, 300, 400, 500, 600, and 700 may be configured to be attached to and detached from the heat exchanger 1. For example, to prevent the bypass of the combustion gas during an operation of the heat exchanger 1, the cover fins 100, 200, 300, 400, 500, 600, and 700 may be coupled to the lower side of the heat exchanger 1. When maintaining the heat exchanger 1, the cover fins 100, 200, 300, 400, 500, 600, and 700 may be removed from the heat exchanger 1. Because the cover fins 100, 200, 300, 400, 500, 600, and 700 are detachable, the user may easily maintain the heat exchanger 1. Because it is easily maintained, a quality of the heat exchanger 1 may be improved.

According to the present disclosure, the combustion gas may be prevented from bypassing.

The above description is a simple exemplary description of the technical spirits of the present disclosure, and an ordinary person in the art, to which the present disclosure pertains, may make various corrections and modifications without departing from the essential characteristics of the present disclosure. Therefore, the embodiments disclosed in the present disclosure are not for limiting the technical spirits of the present disclosure but for describing them, and the scope of the technical spirits of the present disclosure is not limited by the embodiments. The protection scope of the present disclosure should be construed by the following claims, and all the technical spirits in the equivalent range should be construed as being included in the scope of the present disclosure.

What is claimed is:

1. A cover fin comprising:
- a front part and a rear part being perpendicular to a forward/rearward direction and spaced apart from each other in the forward/rearward direction;
- a connecting part connecting the front part and the rear part;
- a leg part extending from an upper end of the rear part toward an upper side when one direction being perpendicular to the forward/rearward direction is defined as an upward/downward direction; and
- a protrusion protruding rearward from the leg part.

2. The cover fin of claim 1, wherein when a direction being perpendicular to the forward/rearward direction and the upward/downward direction is defined as a leftward/rightward direction,
- a width of the front part in the leftward/rightward direction is smaller than a width of the rear part.

3. The cover fin of claim 1, wherein when a direction being perpendicular to the forward/rearward direction and the upward/downward direction is defined as a leftward/rightward direction,
- the connecting part includes:
- a (1-1)-th connecting area connected to a lower end of the front part; and
- a (1-2)-th connecting area connecting the (1-1)-th connecting area and a lower end of the rear part, and
- wherein a width of the (1-1)-th connecting area in the leftward/rightward direction is smaller than a width of the (1-2)-th connecting area.

4. The cover fin of claim 1, wherein when a direction being perpendicular to the forward/rearward direction and the upward/downward direction is defined as a leftward/rightward direction,
- the front part includes:
- a lower end area extending toward the upper side; and
- an upper end area, of which a width in the leftward/rightward direction decreases as it goes from the lower end area to an upper side.

5. The cover fin of claim 1, wherein when a direction being perpendicular to the forward/rearward direction and the upward/downward direction is defined as a leftward/rightward direction,
- the connecting part has a shape that is curved to be convex downward when viewed along the leftward/rightward direction.

6. The cover fin of claim 1, wherein the protrusion includes:
- a first protruding area curved from an upper end of the leg part toward a rear side; and
- a second protruding area curved from an upper end of the first protruding area toward a front side.

7. The cover fin of claim 1, wherein the leg part includes:
- a first leg area extending upward from an upper end of the rear part; and
- a second leg area extending from the first leg area and connected to the protrusion, and
- wherein when a direction being perpendicular to the forward/rearward direction and the upward/downward direction is defined as a leftward/rightward direction,
- the first leg area includes an outer boundary inclined inward with respect to the upper side in the leftward/rightward direction, and an inner boundary inclined outward with respect to the upper side.

8. The cover fin of claim 7, wherein a direction, in which the inner boundary extends, and a direction, in which the outer boundary extends, are not perpendicular to each other.

9. The cover fin of claim 1, further comprising:
- a cover part extending from an area being different from a partial area of the connecting part, which is connected to a lower end of the rear part, toward a rear side.

10. A cover fin comprising:
- a front part and a rear part being perpendicular to a forward/rearward direction and spaced apart from each other in the forward/rearward direction;
- a connecting part connecting the front part and the rear part; and
- a wing part protruding from a side surface of the connecting part in a leftward/rightward direction toward an upper side when one direction being perpendicular to the forward/rearward direction is defined as an upward/downward direction and another direction being perpendicular to the forward/rearward direction and the upward/downward direction is defined as the leftward/rightward direction.

11. The cover fin of claim 10, wherein the wing part includes:
- a first wing area facing the upper side from the side surface and extending while being inclined to an outside of the connecting part; and
- a second wing area facing the upper side and extending from one end of the first wing area while being inclined inward, in the first wing area.

12. The cover fin of claim 10, wherein a plurality of grooves recessed toward a lower side is formed at an upper end of the front part.

13. A heat exchanger comprising:
- a plurality of heat exchange pipelines disposed in a heat exchange area configured to receive heat generated through a combustion reaction and heat heating water, and extending along a forward/rearward direction to receive the heating water and cause the heating water to flow through an interior thereof;
- a plurality of heat fins disposed in the heat exchange area, formed in a plate shape crossing the heat exchange pipelines, and through which the plurality of heat exchange pipelines pass;
- a front plate and a rear plate coupled to front ends and rear ends of the plurality of heat exchange pipelines, respectively; and a cover fin disposed in an interior space between, among the plurality of heat fins, a first heat fin disposed adjacent to the front ends of the plurality of heat exchange pipelines and the front plate, and inserted into the interior space from a lower side toward an upper side when one direction being perpendicular to the forward/rearward direction is defined as an upward/downward direction, wherein the cover fin includes:

a front part contacting the front plate;

a rear part contacting the first heat fin; and a connecting part connecting the front part and the rear part.

14. The heat exchanger of claim 13, wherein the cover fin includes:

a leg part extending from an upper end of the rear part toward the upper side; and a protrusion protruding rearward from the leg part, and wherein the protrusion is inserted into a hole formed in the first heat fin.

15. The heat exchanger of claim 14, wherein the protrusion is inserted into the hole formed in the first heat fin whereby the cover fin is disposed at a lower end of the interior space, which is adjacent to an outside of the heat exchanger.

16. The heat exchanger of claim 13, wherein the cover fin further includes:

a cover part extending from an area being different from a partial area of the connecting part connected to a lower end of the rear part toward a rear side, and wherein the cover part covers lower ends of the plurality of heat fins.

17. The heat exchanger of claim 13, further comprising:

when a direction being perpendicular to the forward/rearward direction and the upward/downward direction is defined as a leftward/rightward direction, a side plate connecting the front plate and the rear plate, wherein the cover fin further includes a wing part protruding from a side surface of the connecting part in the leftward/rightward direction toward an upper side, and wherein the wing part contacts the side plate whereby the cover fin is fixed to the side plate.

18. The heat exchanger of claim 13, wherein a plurality of (1-1)-th grooves recessed toward a lower side and a plurality of (1-2)-th grooves recessed toward the lower side between the (1-1)-th grooves to be thinner than the plurality of (1-1)-th grooves are formed at an upper end of the front part of the cover fin, and wherein the plurality of (1-2)-th grooves contact the plurality of heat exchange pipelines.

19. The heat exchanger of claim 18, wherein the plurality of (1-2)-th grooves contact the plurality of heat exchange pipelines whereby the cover fin is disposed at a lower end of the interior space, which is adjacent to an outside of the heat exchanger.

20. The heat exchanger of claim 13, wherein the cover fin is disposed also in an interior space between, among the plurality of heat fins, a second heat fin disposed adjacent to rear ends of the plurality of heat exchange pipelines and the rear plate.

* * * * *